US007383597B2

(12) United States Patent
Steiner

(10) Patent No.: US 7,383,597 B2
(45) **Date of Patent: *Jun. 10, 2008**

(54) BACKPACKER'S ELEVATED, TENSIONED SLEEPING AND OBSERVATION SURFACE WITH TENT ENCLOSURES AND METHOD OF USE

(76) Inventor: Timothy L. Steiner, Box 234, Colchester, VT (US) 05446

( * ) Notice: Subject to any disclaimer, the term of this patent is extended or adjusted under 35 U.S.C. 154(b) by 1701 days.

This patent is subject to a terminal disclaimer.

(21) Appl. No.: 09/950,424

(22) Filed: Sep. 11, 2001

(65) Prior Publication Data

US 2005/0177938 A1 Aug. 18, 2005

Related U.S. Application Data

(63) Continuation-in-part of application No. 09/494,259, filed on Jan. 28, 2000, now Pat. No. 6,353,946.

(60) Provisional application No. 60/117,970, filed on Jan. 29, 1999.

(51) Int. Cl.
*A45F 3/22* (2006.01)

(52) U.S. Cl. ..... 5/121

(58) Field of Classification Search ..... 5/120–123, 5/128, 130; 135/65, 67, 74, 90, 21
See application file for complete search history.

(56) References Cited

U.S. PATENT DOCUMENTS 4,001,902 A * 1/1977 Hall et al. ..... 5/121
4,575,113 A * 3/1986 Boudreau ..... 280/650
6,711,772 B2 * 3/2004 Grassi ..... 7/158

* cited by examiner

*Primary Examiner*—Patricia Engle
*Assistant Examiner*—Fredrick Conley
(74) *Attorney, Agent, or Firm*—Eric R. Benson, Esq.

(57) ABSTRACT

This invention relates to wilderness camping and backpacking, specifically to increasing the overall comfort of tent sleeping by elevating the sleeper and tent from ground contact and conditions while keeping pack weight comfort of the invention conducive to backpacking use.

14 Claims, 9 Drawing Sheets

BACKPACKER'S ELEVATED, TENSIONED SLEEPING AND OBSERVATION SURFACE WITH TENT ENCLOSURES AND METHOD OF USE

CROSS REFERENCE TO RELATED APPLICATION

This Application is a Continuation-In-Part of the patent application U.S. Ser. No. 09/494,259 filed on Jan. 28, 2000 now U.S. Pat. No. 6,353,946 and claiming priority from Provisional Patent Application No. 60/117,970 which was filed on Jan. 29, 1999.

BACKGROUND ART

The use by campers and hikers of elevated sleeping surfaces is known in the prior art. For example, U.S. Pat. No. 1,401,846, which issued to Wiles on Dec. 27, 1921, discloses an elevated camper's bed of a hammock design. Elevated sleeping surfaces for campers are similarly disclosed in U.S. Pat. No. 4,001,902, which issued to Hall et al. on Jan. 11, 1977, (hammock device with a sleeping bag and tent attached); U.S. Pat. No. 4,071,917, which issued to Mojica on Feb. 7, 1978, (hammock device with a canopy); U.S. Pat. No. 4,308,883, which issued to Malone on Jan. 5, 1982, (suspended tent with rain guard device); U.S. Pat. No. 4,320,542, which issued to Cohen on Mar. 23, 1982, (suspended shelter); U.S. Pat. No. 5,072,465, which issued to Lyons, Jr. on Dec. 17, 1991, (suspendable sleeping bag); and U.S. Pat. No. 5,240,021, which issued to Snodgrass on Aug. 31, 1993, (suspended sleeping surface tent where base rests upon the ground). As such, the basic concept of camping and recreation based elevated sleeping surfaces and their use are disclosed.

There have been attempts made in the prior art to increase comfort for wilderness sleeping by raising the sleeping devices off the ground. Primarily, this has been done by the use of hammocks which are supported by tying the sleeping devices to trees at two end points. The stability of said hammocks is achieved by supporting the occupant in a sack-like manner. The user must actively balance himself in the hammock and maintain a modicum of an active sense of balance even during sleep. The sleeping position is primarily restricted to sleeping on the back. The sleeping posture is uncomfortably curled by the sag of the hammock. Any attempt to tension the hammock to be more level, taut, and firm results in dramatically decreased stability. When screening and tenting are added to create shelter, the two-point hammock becomes very difficult to use and, in the event of an imbalance accident, likely to find the user upside down in the unit and tangled in the tenting.

While there are unpatented art sleeping surfaces designed to include high tree use which gain stability by using four attachment points, this art neither teaches or claims a tensioning device or design for flat, taut, bed-like sleeping, but rather cradles the user in the same sack-like manner of support as does the two point hammock design. This art is essentially a sleeping surface comprised of a sheet held at all four corners.

Lastly, the popular "Newell" hammock, U.S. Pat. No. 4,686,720, is typical of the several so-called "Jungle Hammocks" disclosed above and shares the same disadvantages as noted above. The sleeping surfaces of the prior art are uncomfortable and unstable.

While each of these prior art patents disclose suspended sleeping surfaces for camping and recreational purposes which fulfill their respective particular objectives and requirements, and are most likely quite functional for their intended purposes, it will be noticed that none of the prior art cited disclose an apparatus and/or method that allow a user the comfort of sleeping suspended above the ground without the discomfort of the cramped and unnatural position with which a hammock places the users body, and/or the discomfort and danger of sleeping on an unstable surface. As such, there apparently still exists the need for new and improved suspended sleeping surface to maximize the benefits to the user and minimize the risks of injury from its use. In this respect, the present invention disclosed herein substantially fulfills this need.

DISCLOSURE OF THE INVENTION

In view of the foregoing limitations inherent in the known types of hammocks, suspended sleeping surfaces and methods of use thereof now present in the prior art, the present invention provides an apparatus and method of use of a hammock that has been designed by an avid outdoors person and camper in an environmentally challenging setting which are improvements which are patently distinct over similar devices and methods which may already be patented or commercially available. As such, the general purpose of the present invention, which will be described subsequently in greater detail, is to provide a field designed apparatus and method of use that incorporates the present invention. There are many additional novel features directed to solving problems not addressed in the prior art.

To attain this the present invention generally comprises a multi-point stabilized suspended sleeping surface with an easy to use tensioning device, and its detailed fundamental concepts, generating both stable and comfortable applications and the technology needed to apply it.

Several objects and advantages of the present invention are:

unlike the prior art sleeping surfaces utilizing a hammock design, the present invention provides a firm, cot-like sleeping surface. Also, unlike a cot this invention does provides a stable sleeping surface without a full frame and the subsequent weight and ungainly structure this creates for the backpacker while trying to hike while carrying the device;

unlike prior art suspended sleeping surfaces such as hammocks and covered hammocks, the present invention provides the stability of more than two attachment points spread around the perimeter of the unit and under tension so that the user need not concern himself with balance and may sleep soundly in any position or move about in their sleep;

the present invention provides the opportunity to level the sleeping platform, regardless of ground grade, by adjusting the height of the various attachment points which facilitate the suspension of the sleeping platform and furthermore prior art two-point attached hammocks may allow for adjustment of the level on the ends, but lateral leveling of the sleeping surface is not possible insofar as stability depends on allowing the center to sag far below level under occupant load;

the present invention also provides for ease of set up to the devices designed dimensions and shape in what is a typically asymmetrical forest tree settings by the pullied self-adjustment of the device's attachment lines. While prior art suspended sleeping platforms of a hammock design need only two trees properly spaced for set up, the self-adjustment properties of the present invention make it possible to locate almost as many suitable sites for set up of the device as may be found for setting up two-point hammocks;

the present invention further provides a firm base on which to erect a tent and screen shelter designed for it according to the styles, principles, and developments of modern wilderness/backpacking tent design. This shelter may be designed to include dry storage under the sleeping surface without the need for a floor waterproofing or heavier floor cloth, and may be tightly fixed to its base and guyed down to the unit's supporting lines for inclement wind and weather;

the present invention also provides an advancement in ecological protection by eliminating the need for trenching and other disturbances of the forest floor at the camping site;

the present invention further provides, in using the Tree-Saver Bands of the design, for ecological protection of the trees used to support the unit by protecting their bark from the damage of having rope under tension directly attached to the them as do the prior art hammocks; and in one embodiment of the present invention it provides a sturdy hiking stick to the user when not set up for sleeping use thus adding to the combined practical value of the invention for a packweight-conscious sport, reducing the back carried weight at the same time it provides another essential and favored element of the sport, a hiking stick. No prior art anticipating this advantageous combination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BEST MODES FOR CARRYING OUT THE INVENTION

I. Preferred Embodements

Utilizing a Hiking Stick Apparatus

Figure 1:
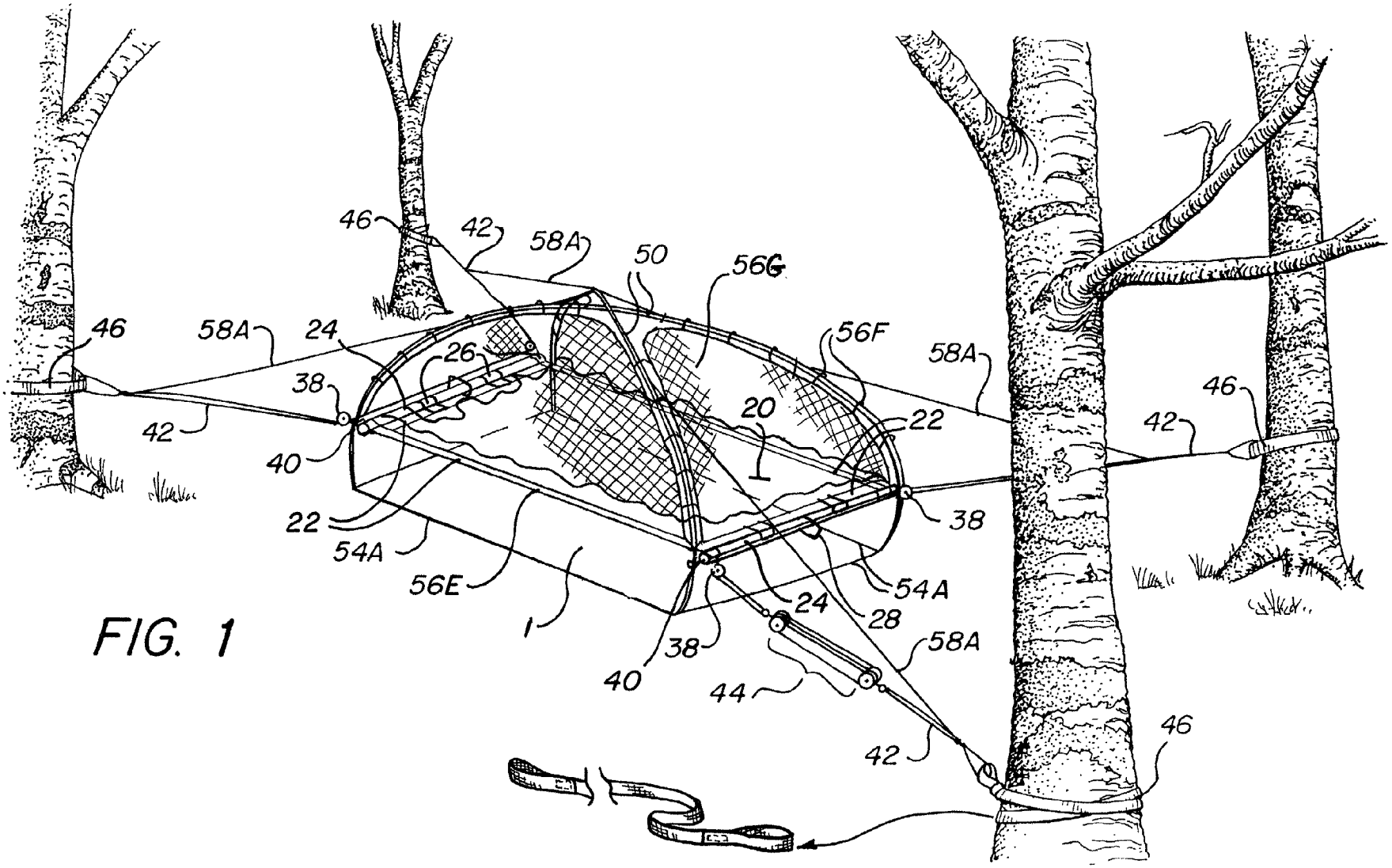
FIG. 1 is a perspective view of the four attachment point embodiment depicted in use with the tent fly removed, tent panels unzipped, and only the screen panels zipped in place; with tree-saver bands, tree attachment lines and tensioner also in view.
Figure 1A:
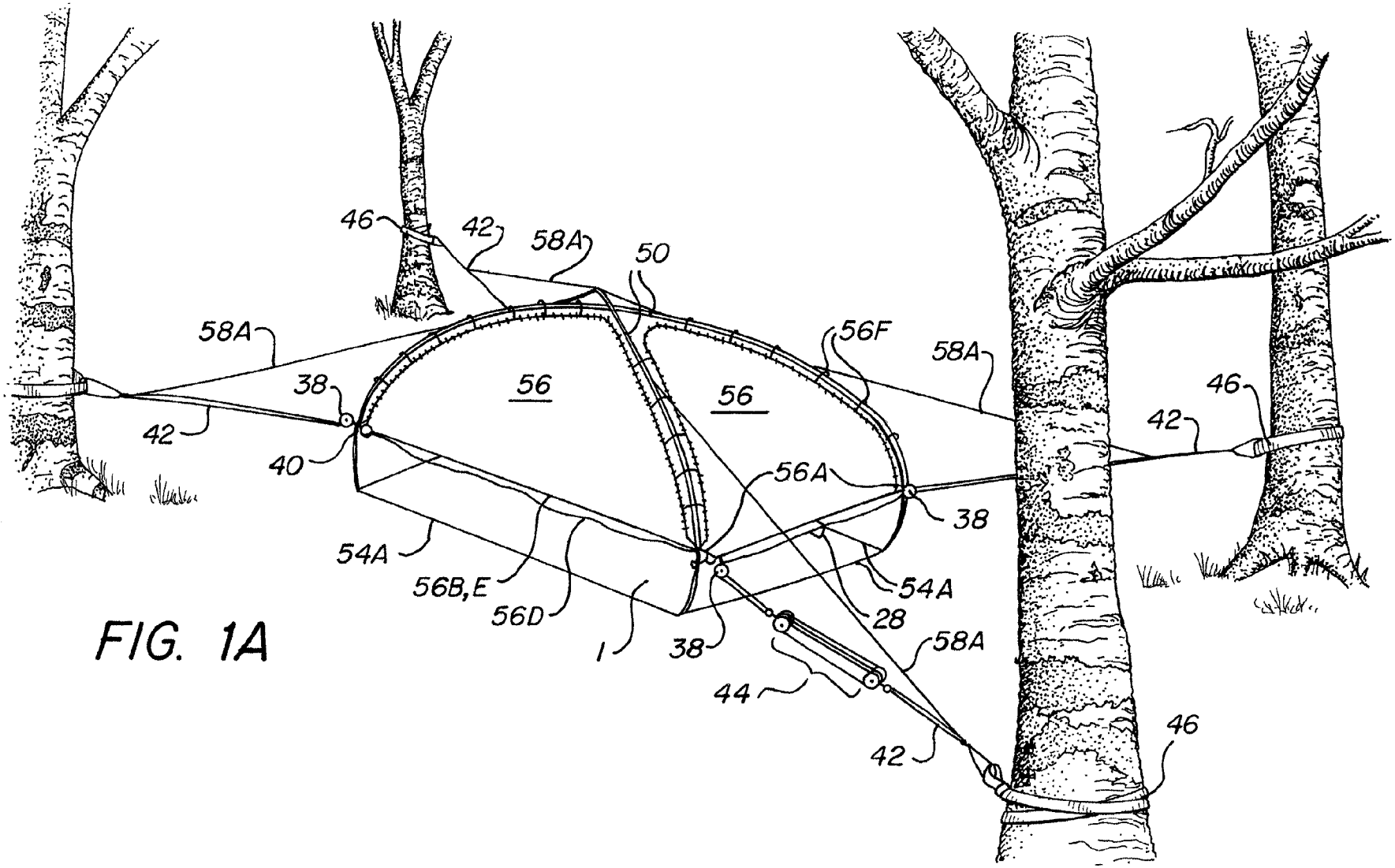
FIG. 1A is a perspective view of the four attachment point embodiment depicted in use with the tent fly removed and the tent panels zipped into place.
Figure 1B:
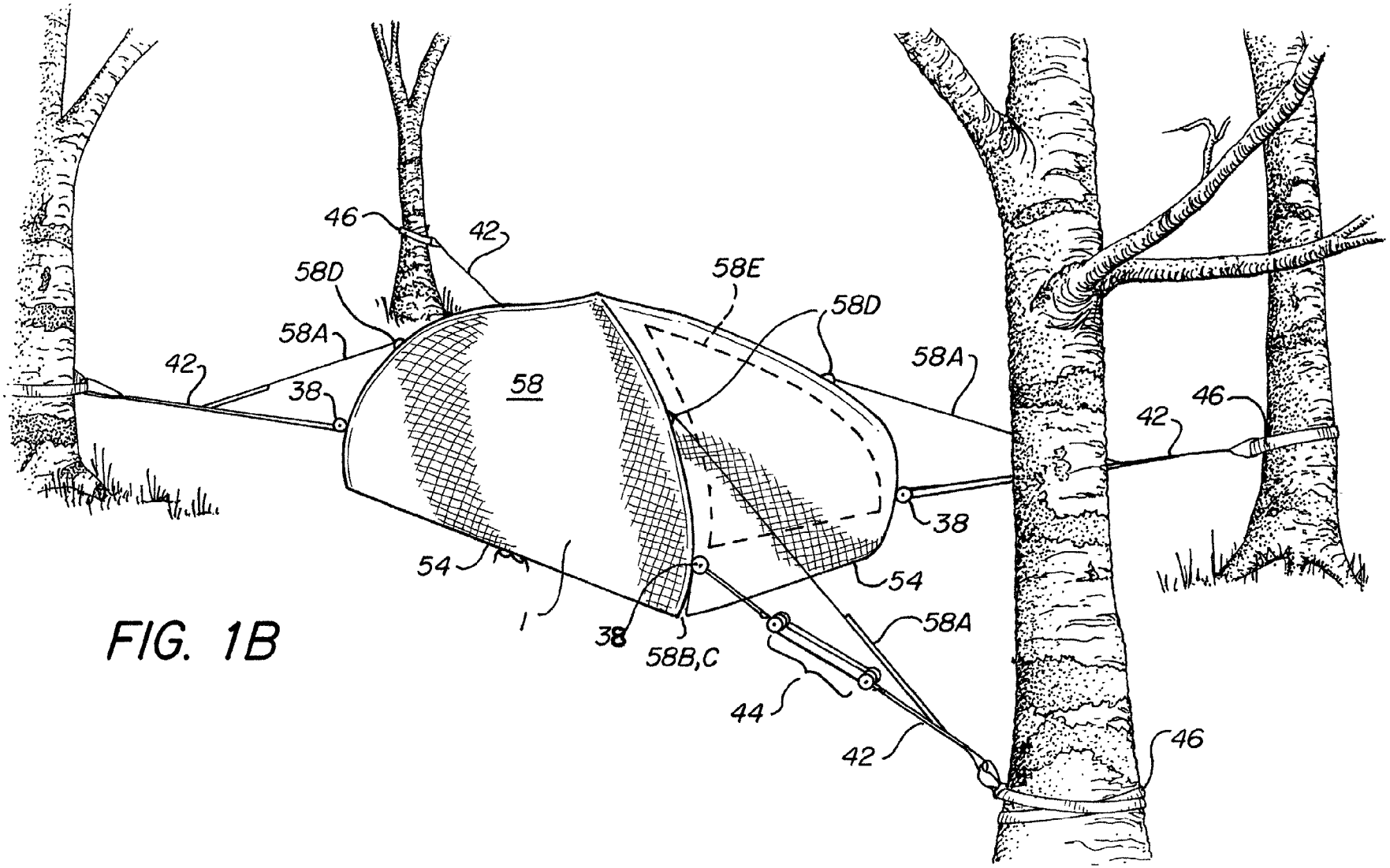
FIG. 1B perspective view of the four attachment point embodiment depicted in use with the tent fly in place.
Figure 2:
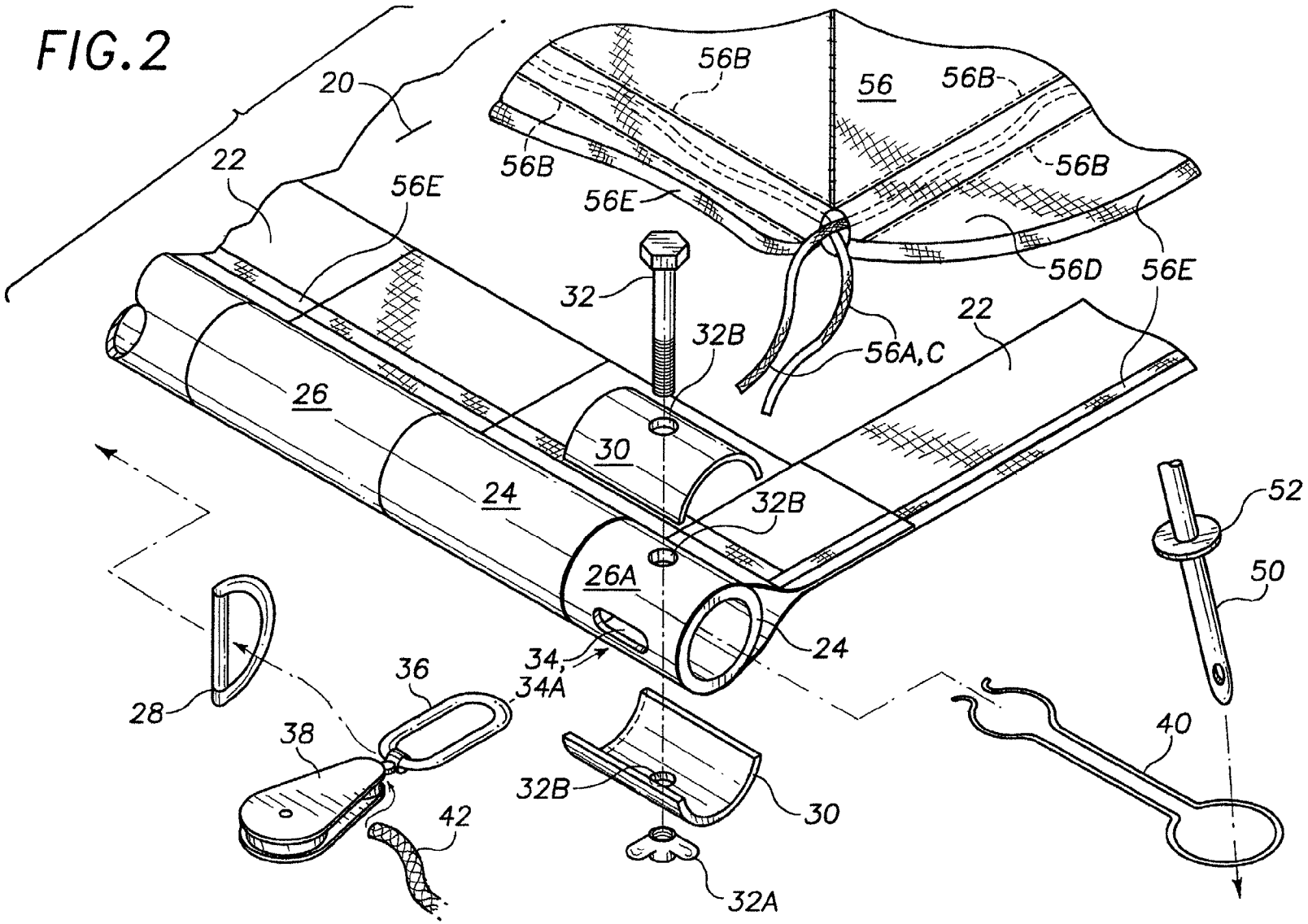
FIG. 2 is an exploded perspective view of the assembly elements of one of four corners of the four attachment point embodiment.
Figure 3:
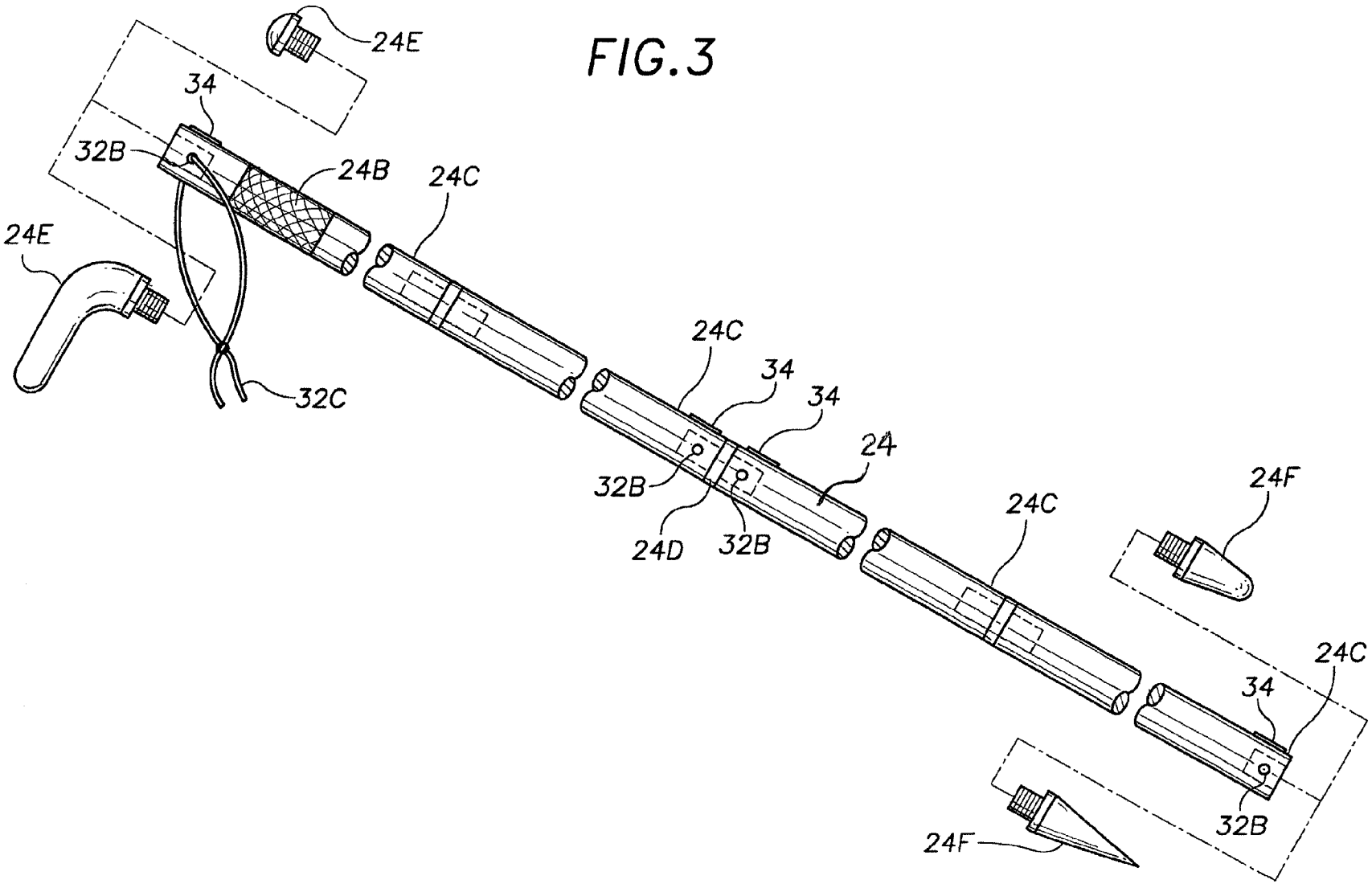
FIG. 3 is a perspective view of the partially disassembled combination end-frame tubes/hiking stick.
Figure 4A:
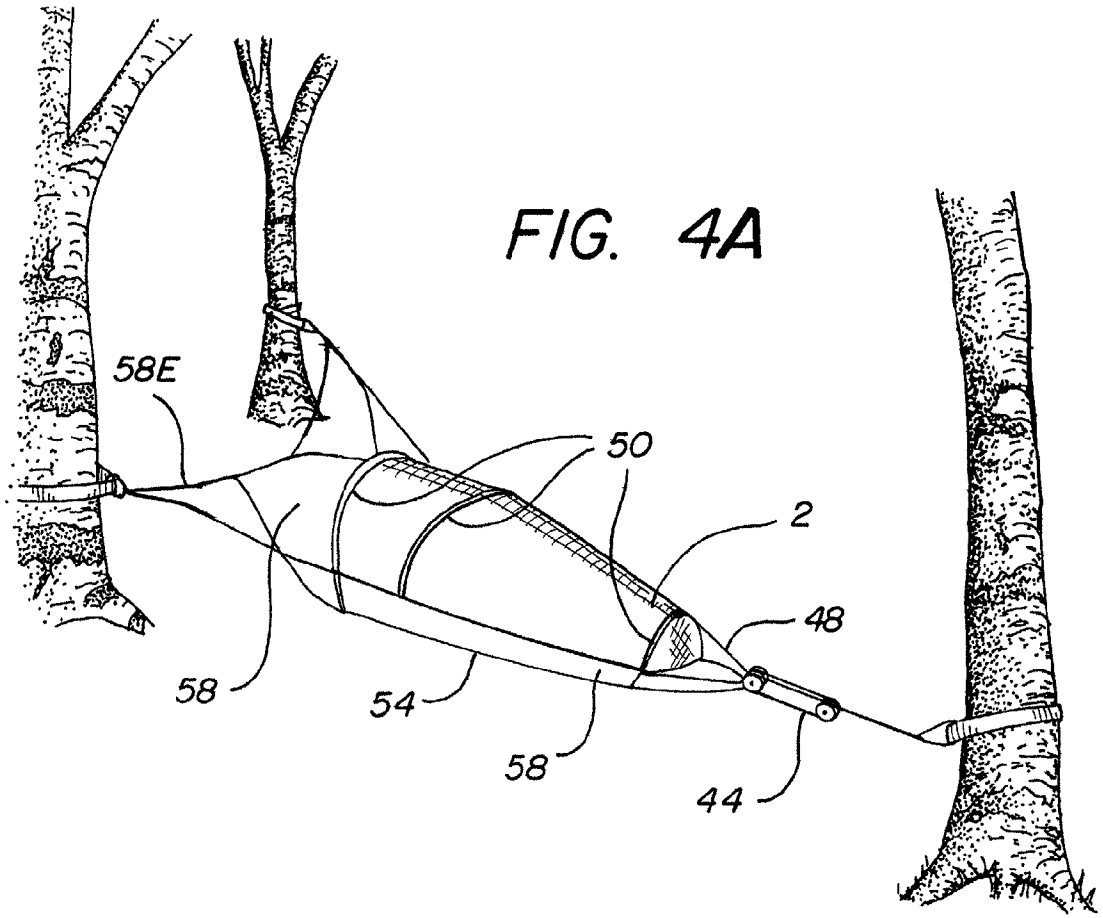
FIG. 4A depicts a perspective view of the ultralight three point attachment embodiment.
Figure 4B:
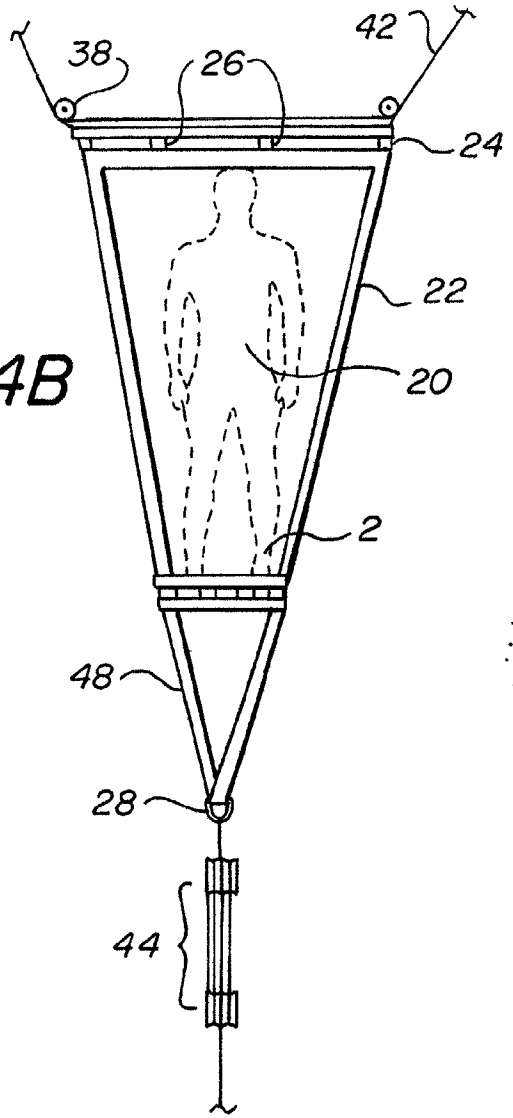
FIG. 4B depicts a top view of the ultralight three point attachment embodiment.
Figure 4D:
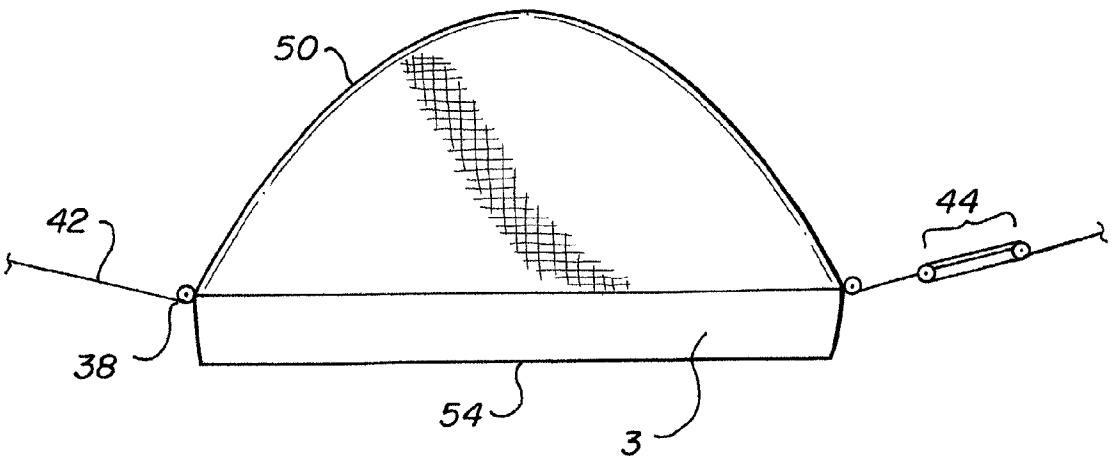
FIG. 4D depicts a side view of the two person pyramid dome three point attachment embodiment.
Figure 4C:
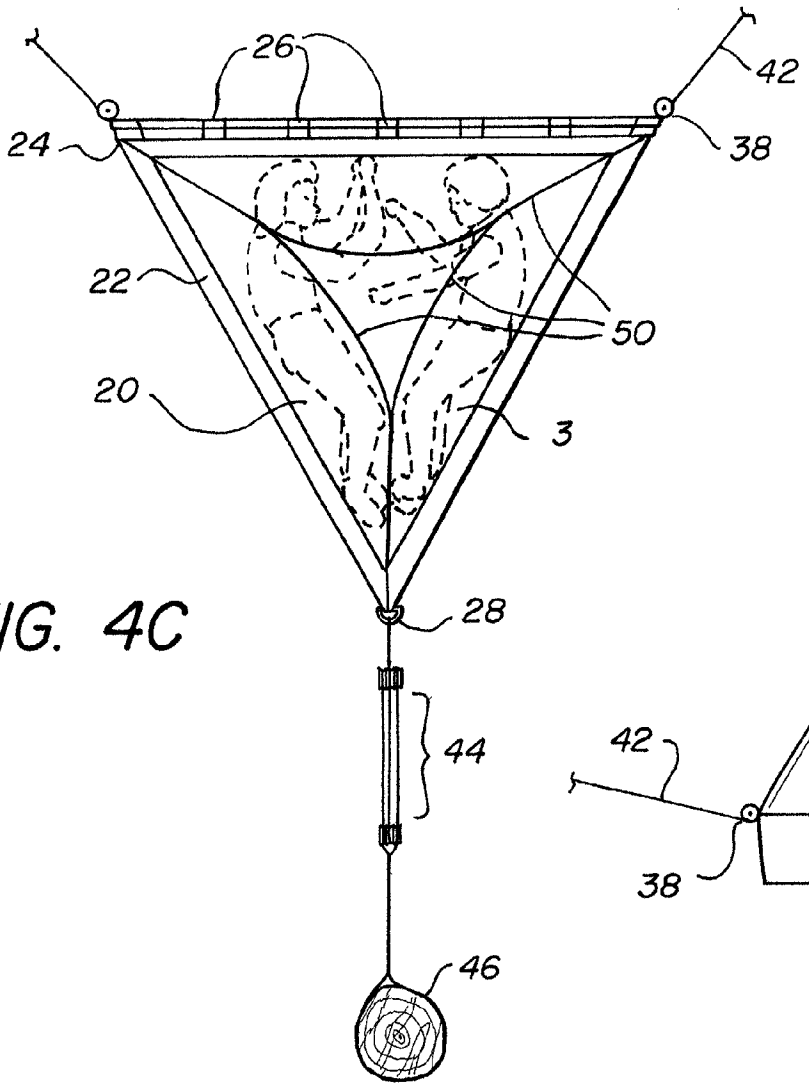
FIG. 4C depicts a top view of the two person pyramid dome three point attachment embodiment.

With reference now to the drawings, and in particular to FIGS. 1-4 thereof, a new and novel apparatus and method of use of the apparatus for a suspended sleeping surface embodying the principles and concepts of the present invention and generally designated by the reference numeral 1 in FIGS. 1, 1A, 1B and in another "3 point" embodiment by the reference numeral 2 in FIGS. 4A & 4B and in yet another "two person" embodiment by the reference numeral 3 in FIGS. 4C & 4D.

List and Description of:

General Description of Reference Numerals In Drawings

Any actual dimensions listed are those of the preferred embodiment. Actual dimensions or exact hardware details and means may vary in a final product or most preferred embodiment and should be considered means for so as not to narrow the claims of the patent.

Reference numeral 20 (FIGS. 1, 2, 4B, 4C) depicts a floor made of fabric of a high strength-to-weight, weight-bearing fabric floor, ballistics cloth in the preferred embodiment.

Reference numeral 22 (FIGS. 1, 2, 4B, 4C) depicts a perimeter web of high strength nylon webbing/(web frame) sewn into the perimeter of the floor 20 2" nylon flat tube webbing, 8000 lb. test is used in the prototype.

Reference numeral 24 (FIGS. 1, 2, 3, 4B, 4C) depicts end-frame tubes/hiking stick, in the preferred embodiment, 6061 grade aluminum tubing of 1¼" outside diameter. Other lightweight-to-strength materials, such as carbon fiber tubes, and other hiking stick assembly methods and parts such as a twist-lock system may be sought and substituted for these assembly parts below as engineering and production proceed.

Hiking Stick Assembly Parts (FIG. 3) (Numbers 24A-D)

Reference numeral 24 as shown in (FIG. 3) depicts the end-frame tubes/hiking stick for the preferred embodiment and is comprised of four sections. This keeps the length of each section short enough to pack in or on most backpacks. Lengths will vary as design embodiments occur, but in the preferred embodiment disclosed, the 4 attachment point embodiment uses four 18" sections meant to join as two matched units for tent floor/sleeping surface use. For hiking stick use, this means a possible total length of 72," a massive hiking stick. Also, one section may be left out for a length of 54. " Also, only two sections may be used for a cane length of 36. " Unused sections remaining are packed.

Reference numeral 24B (FIG. 3) in each embodiment, depicts a machine gnurled area handgrip near one end of one section of the end-frame tubes/hiking stick 24 and this machine gnurled area handgrip 24B section is intended to be used as the top section.

Reference numeral 24C (FIG. 3) depicts internally threaded sections to receive double male unions with mid-stops 24D to join the four sections of the end-frame tubes/hiking stick 24 together.

Reference numeral 24D (FIG. 3) depicts an externally threaded double male unions with mid-stops designed to connect all sections by being threadedly received in the internally threaded sections 24C to receive and join sections together.

Reference numeral 24E (FIG. 3) depicts a top cap threaded plug which may be provided; alternatively, a cane handle threaded top, not depicted in the drawing, may be provided for use with a cane-length, shortened hiking stick.

Reference numeral 24F (FIG. 3) depicts a rubber ground tip attached to a threaded plug removably attached to the bottom end section; alternatively, a threaded ice-pike may be removably attached for use.

Chain link slots 34 and web loop clamp bolt holes 32B in the end-frame tubes/hiking stick for tent floor assembly 20 and 22 (FIGS. 1, 2, 4B, 4C) are described below; the web loop clamp bolt holes 32B at the end with the gnurled hand grip feature 24B could be used to install a wrist thong 32C.

Reference numeral 32C (FIG. 3) depicts a wrist thong of leather or other suitable material for hiking stick use.

Reference numeral 26 (FIGS. 1, 2, 4B, 4C) depicts a plurality of web loops sewn, as needed for support, to the perimeter web 22 of the ends of the floor assembly 20 and 22 to snugly receive the end frame tubing/walking stick 24 when it is slid into them.

Reference numeral 26A (FIG. 2) depicts a plurality of corner web loops sewn, as needed for support, to the perimeter web 22 at the corners of the floor assembly 20 and 22 to snugly receive the end frame tubing/walking stick 24 when it is slid into them and said corner web loops 26A having properly sized, sewn and shaped hole therein to expose the web loop clamp bolt holes 32B and said corner web loop 26A further having a corner web loop chain link slot 34A (FIG. 2) to expose the chain link slots 34 when the end frame tubing/walking stick 24 is fit into place for the device's use as a sleeping surface.

Reference numeral 28 (FIGS. 1, 1A, 2) depicts a loose D-ring that is slid over the end frame tube to its center as the floor assembly 20 and 22 web loops 26 are being installed on the tubes during set-up assembly. The D-ring has been essential in the prototype as a midpoint brace for the end frames with the tree line led through it between the blocks at the ends, but it may be eliminated as stronger materials are found for the end frames.

Reference numeral 30 (FIG. 2) depicts web loop clamps that consist of an arc of approximately 120 degrees of the 6061 tubing, cut at the same length as the width of the webbing. Two of these arc clamps are placed over the end web loop at each end of the end frame tube, one on top and one on bottom, opposed. Thence a web loop clamp bolt, (standard steel grade hex head ¼"×2" with wingnut) in the prototype), 32 (FIG. 2) is inserted through a web loop clamp bolt hole 32B in the center of the top clamp piece, thence through the underlying web loop, thence through the tubing, the other part of the web loop opposite, thence through the other clamp installed opposite. A web loop clamp wingnut 32A (FIG. 2) is then installed on the bottom allowing the clamp to be hand-tightened down on the web thus securing it in its position on the tube it encircles.

Reference numeral 34 (FIG. 2) depicts a chain link slot in the end frame (and through the corner web loop chain link slot 34A (FIG. 2) of adequate size provided and aligned centered with the center of the web loop clamp bolt holes 32B, and at 90 degrees around the circumference from the web loop clamp bolt holes' 32B axis.

Reference numeral 36 (FIG. 2) depicts a single chain link, typically ¼" which is inserted into the tube 24 (FIG. 2) via the chain link slot 34 (FIG. 2) and the web loop clamp bolt 32 (FIG. 2) is passed through it at set-up, also. This chain link 36 is the attachment point for the swivel-mount block 38 (FIGS. 1, 1A, 1B, 2, 4B, 4C, 4D).

Reference numeral 38 (FIGS. 1, 1A, 1B, 2, 4B, 4C, 4D) depicts swivel-mount blocks with swivel shackles. The swivel-mount blocks 38 are lightweight-to-strength, marine-quality blocks with swivel shackle mounts; blocks sized for ½ line are suitable for use in the preferred embodiment.

Reference numeral 40 (FIGS. 1, 1A, 2) depicts spring clips and their attachment point utilizing the web loop clamp bolt 32 (FIG. 2) via the open end of the end frame tube, These clips support the tent wand hoops 50 (FIGS. 1, 1A, 2, 4A, 4C, 4D) which are applied later in set-up of the tent.

Reference numeral 42 (FIGS. 1, 1A, 1B, 2, 4B, 4C, 4D) depicts the tree lines which are comprised of ½" or thicker static (non-stretch) lines comprised of a set of two lines for the 4 attachment point present embodiment. One line would serve for 3 attachment point embodiments (FIG. 4). Lines 10'-15' in length are anticipated to be supplied with the unit although longer tree lines could be used which may be more suitable under particular set-up conditions. Each tree line is rove through both swivel-mount blocks 38 (FIGS. 1, 1A, 1B, 2, 4B, 4C, 4D) at both ends of each end-frame tubes/hiking stick 24 (FIGS. 1, 2, 3, 4B, 4C) and thence led toward each respective tree/attachment point of the two trees/points chosen for each end. On the 3 attachment point embodiments, the narrow, foot end is attached directly to the tensioner 44 (FIGS. 4A, 4B, 4C, 4D) by a karabiner, quick-link, or other appropriate rigging hardware and thence to a single tree via another rigging link to the tree-saver bands 46 (FIGS. 1, 1A, 1B, 4C) where a separate tree line 42 (FIGS. 1, 1A, 1B, 2, 4B, 4C, 4D) is not needed unless more length is required.

Reference numeral 44 (FIGS. 1, 1A, 1B, 4A, 4B, 4C, 4D) depicts the tensioner which is comprised of a lightweight, high-strength-rated block and tackle with two blocks on one end and three at the other (5:1) and with a cam cleat line-lock built into the block assembly at one end (similar to the main sheet or vang arrangement for a small sailing sloop). The tensioner 44 is sized for ¼" to 5/16" static line. At full extension, about 48" of length is adequate to practice this invention. Applying tension, shortens the unit as much as down to where the blocks and lines are as close as their mass will allow them to come, which generally is less than 12 inches. This allows at least 36" of play for adjusting the tension of the floor assembly 20 and 22 (FIGS. 1, 2, 4B, 4C) and adjusting the floor 20 to come to square in a typical asymmetrical forest tree setting. The tensioner 44 as disclosed has proven sufficient to attain the object of this invention in field trials for these two tasks.

Reference numeral 46 (FIGS. 1, 1A, 1B, 4C) depicts the tree-saver bands which are comprised of lengths of nylon webbing, a similar strength webbing material as used in the floor assembly 20 and 22 perimeter web 22 (FIGS. 1, 2, 4B, 4C) in lengths ranging from 4' to 10'. Four tree-saver bands 46 would be included for use with each 4 attachment point embodiment and three tree-saver bands 46 for each 3 attachment point embodiment (FIGS. 4A, 4B, 4C, 4D). Each tree-saver band 46 has a section of working end turned back at each end and sewn flat to the standing part with heavy bar-stitching so that approximately a 4" loop is formed (The loop should be of sufficient size to easily pass the other end of the band through it). These bands are wound around the selected tree in various configurations as required by the set-up situation as attachment points for the tree lines 42. The tree-saver bands 46 prevent chafe damage to the trees, allow for length variants in the set-up, and allow for easy leveling adjustments for the tree lines 42 during set-up.

Reference numeral 48 (FIGS. 4A, 4B) depicts a triangular yoke web extension of a 3 attachment point embodiment. At the foot end, the tensioner is attached directly to the triangular yoke web extension 48 of the floor assembly 20 and 22 perimeter web 22 via appropriate rigging hardware and thence led to the tree/attachment point.

Tent and Tent Assembly Features

Individual spring clips 40 (FIGS. 1, 1A, 2) insert singly into both tube ends of the end-frame tubes/hiking stick 24 for the preferred embodiment, as needed for other embodiments. Four spring clips 40 are used in the four attachment point embodiment and two spring clips 40 are used in the three attachment point embodiment.

Reference numeral 50 (FIGS. 1, 1A, 2, 4A, 4C, 4D) depicts the tent wand hoops which are flexible, fiberglass, pole-and-socket jointed, hollow and shock-corded together, assemblable hoops which are now typical framing for most lightweight tents.

Two hoops comprised of packable sections about 24" long typically assemble into about 12' lengths. In the 4 attachment point embodiment, two of these 12' lengths are provided. Configuration is different for other embodiments (FIGS. 4A, 4C, 4D). The ends of these assembled hoops are inserted into the formed eye at the outboard end of the spring clip 40 (FIGS. 1, 1A, 2), thence quarter-corner to the spring clip 40 eye at the diagonally opposed end.

Reference numeral 52 (FIG. 2) depicts a stopper gasket near each end of each tent wand hoop 50 (FIGS. 1, 1A, 2, 4A, 4C, 4D), larger than the receiving eye of the spring clip 40 (FIGS. 1, 1A, 2) such that about 14 inches of the wand protrudes through the eye and the tent wand hoop 50 is impeded from going any further. This protrusion through the eye is to allow for an oversize fly 58 (FIG. 1B), atypical of standard ground tents, which will proceed past the floor 20 level and provide for an under-floor 20, out-of-weather storage area for lashing and hanging equipment.

As depicted in the four attachment point embodiment the fly 58 (FIG. 1B) is further comprised of a fly draw-string 54 (FIG. 1B) sewn into its bottom-edge of the fly 58 so that tightening it in place will recurve (draw in) the bottom on the 4 tent wand hoop 50 ends to a drum-like tautness.

The tent wand hoops 50 proceed up out of their anchoring eyes and form natural curved arches defined by their length and attachment point diameter and cross each other above the middle of the floor assembly 20 and 22 and at about the height of the finished tent 56 (FIGS. 1A, 1B, 2).

The tent 56 (FIGS. 1A, 1B, 2) is made in four openable panels with narrow anchor panels between (configured differently for other embodiments although the same construction principles apply as in (FIGS. 4A, 4B, 4C, 4D)) wherein the sides and ends of the tent 56 conform to the dimensions of the floor assembly 20 and 22 and the assembled tent wand hoop 50 profiles. Each corner of the tent 56 (FIGS. 1A, 1B, 2) is fixed with tent corner ties (and/or drawstrings) 56A (FIGS. 1A, 2) to a chain link 36 (FIG. 2) at each coinciding corner of the floor assembly 20 and 22. A straight base seam 56B (FIGS. 1A, 2) proceeds along each side of the base of the tent 56 between the tent corner ties 56A. This straight base seam 56B may also include a base seam draw-string 56C (FIG. 2) from corner to corner. Below the straight base seam 56B of the tent 56 on the long sides, a catenary and load-sag curved panel 56D (FIGS. 1A, 2) is sewn to accommodate movement and sag of the floor assembly 20 and 22. Along the bottom of these catenary and load-sag curved panels 56D and along the bottom of the end panels (all four sides) a hook and loop tape 56E (FIGS. 1, 1A, 2) is sewn. An additional hook and loop tape 56E is sewn to the outside of the perimeter web 22 of the floor assembly 20 and 22 (FIGS. 1, 2) tent 56 (FIGS. 1A, 2) and floor assembly 20 and 22 (FIGS. 1, 2) are joined thereby. The tent 56 is tether hooked utilizing a shock-corded hook 56F (FIGS. 1, 1A) to the supporting tent wand hoops 50 such that it is tightly stretched. The tent 56 is comprised of four, breathable, nylon, opaque panels corresponding to the sides and ends of the floor assembly 20 and 22 and filling the area perimetered on each of the four sides by the floor assembly 20 and 22 and profile of the adjacent tent wand hoops 50. Each panel may be zipped open with a double action zipper, being attached to a narrow fabric band under the tent wand hoop 50 attachment area and between the panels. Double action zippered panels of flexible screen 56G (FIG. 1) ("no-see-um" cloth) underlie the tent's 56 four, breathable, nylon, opaque panels. The panels may be opened and closed in any possible configuration.

The fly 58 (FIG. 1B) is comprised of non-breathable, coated, waterproof nylon or other suitable material. It lays over the tent wand hoop 50 formed frame and is pulled taut by way of the fly draw-string 54 (FIG. 1B) in its base and by any additional fly guylines 58A (FIGS. 1, 1A, 1B) necessary for the design. The fly 58 (FIG. 1B) stands off from the surface of the tent 56 (FIGS. 1A, 1B, 2) by approximately 2" so that an air flow can exist between the two. This keeps the inner tent dry of respiratory condensation as said condensation passes through the breathable tent wall and deposits on the interior of the fly where air flow evaporates it and carries it away.

Summary of the Preferred Embodiments the preferred embodiments of this invention provide for sheltered, stable, comfortable, bed-like sleeping, off the ground in a wooded setting with an overall weight and packed size that are within the constraints of modern backpacking's needs. Part of the weight of the unit can be carried in the hand as an assembled hiking stick thus cutting pack weight more and providing an additional and alternative practical use for some of the hardware of the invention for the wilderness traveler.

Description of the Preferred Embodiment—FIGS. 1-4, Detail Reference Numbers 20-58

The preferred embodiment of the present invention is illustrated in FIGS. 1, 1A, 1B, perspective views of the particular embodiment in different stages of set-up and use. FIGS. 4A, 4B, 4C, 4D illustrates several views of other potential embodiments. The following reference to the drawings are primarily of the preferred 4 attachment point embodiment, but the other potential embodiments contain most of the same features and employ all of the same principles of the invention. Any significant differences between the embodiments will be noted in the following description. Of the embodiments, the 4 attachment point present and preferred embodiment is the most stable while the 3 attachment point embodiments trade some lessened stability as the user proceeds toward the foot end for a relative overall lighter pack weight and hiking stick weight.

BRIEF DESCRIPTION OF REFERENCE NUMERALS

1 (FIGS. 1, 1A, 1B) 4 Point Attachment Embodiment
2 (FIGS. 4A, 4B) 3 Point Attachment Embodiment
3 (FIGS. 4C, 4D) 2 Person 3 Point Attachment "Pyramid Dome" Embodiment
20 (FIGS. 1, 2, 4B, 4C) Floor
22 (FIGS. 1, 2, 4B, 4C) Perimeter Web
24 (FIGS. 1, 2, 3, 4B, 4C) End frames/hiking stick
24B (FIGS. 3) Machine Gnurled Area Handgrip
24C (FIGS. 3) Internally Threaded Sections
24D (FIGS. 3) Double Male Unions with Midstops
26 (FIGS. 1, 2, 4B, 4C) Web Loops
26A (FIGS. 2) Corner Web Loop
28 (FIGS. 1, 1A, 2) Loose D-Ring
30 (FIG. 2) Web Loop Clamps
32 (FIG. 2) Web Loop Clamp Bolt
32A (FIG. 2) Web Loop Clamp Wingnut
32B (FIG. 2) Web Loop Clamp Bolt Holes
34 (FIG. 2) Chain Link Slot
34A (FIG. 2) Corner Web Loop Chain Link Slot
36 (FIG. 2) Chain Link
38 (FIGS. 1, 1A, 1B, 2, 4B, 4C, 4D) Swivel-Mount Block
40 (FIGS. 1, 1A, 2) Spring Clips
42 (FIGS. 1, 1A, 1B, 2, 4B, 4C, 4D) Tree Lines
44 (FIGS. 1, 1A, 1B, 4A, 4B, 4C, 4D) Tensioner
46 (FIGS. 1, 1A, 1B, 4C) Tree-Saver Bands
48 (FIGS. 4A, 4B) Triangular Yoke Web Extension
50 (FIGS. 1, 1A, 2, 4A, 4C, 4D) Tent Wand Hoops
52 (FIG. 2) Stopper Gasket
54 (FIG. 1B) Fly Draw-String
54A (FIG. 1) Fly Absent Draw-String
56 (FIGS. 1A, 1B, 2) Tent
56A (FIGS. 1A, 2) Tent Corner Ties
56B (FIGS. 1A, 2) Straight Base Seam
56C (FIG. 2) Base Seam Draw-String
56D (FIGS. 1A, 2) Caternary and Load Sag Curved Panel
56E (FIGS. 1, 1A, 2) Hook and Loop Tape
56F (FIGS. 1, 1A) Shock-Corded Hook
56G (FIG. 1) Flexible Screen
58 (FIG. 1B) Fly
58A (FIGS. 1, 1A, 1B) Fly Guylines
58B (FIG. 1B) Fly Slot
58C (FIG. 1B) Hook and Loop Fasteners
58D (FIG. 1B) Sewn-In Tabs and Rings
58E (FIG. 4A) Yoke Guy

DETAIL DESCRIPTION OF THE PREFERRED EMBODIMENT

The present invention's preferred embodiments are composed of a sleeping floor area of approximately the size and length-to-width ratio of a cot or single mattress. A second, smaller embodiment is proposed which is essentially a narrow triangular shaped 3 attachment point embodiment as depicted in FIGS. 4, 4B, 4C, and 4D. Additional and larger embodiments utilizing the technology of this claimed invention are intended to be included within this description and claims that follow. The floor 20 (FIGS. 1, 2, 4B, 4C) is composed of a heavy, weight-bearing fabric bound on all of its sides, as a perimeter, to a sewn-in, wide, nylon or Dacron, static (non-stretch) perimeter web 22 (FIGS. 1, 2, 4B, 4C) approximately 2 inches in width of significant tensioning/load bearing strength, both for bearing the occupant and load and for lashing/tensioning smaller trees or branches tightly together (larger trees are presumed stable and are regarded as unmoving anchor points). In the preferred embodiments depicted in the drawings, ballistics cloth is used for the floor 20 of 8000# test tubular weave, flat, 2" nylon webbing is used as the perimeter web 22 edge of the floor 20 cloth. Lighter weight materials of similar strength may be used.

Along the short edges or ends of the floor 20, a plurality of web loops 26 (FIGS. 1, 2, 4B, 4C) of the same flat nylon webbing is sewn to the end of the perimeter web 22 of the floor 20. These web loops 26 admit end-frame tubes/hiking stick 24 (FIGS. 1, 2, 3, 4B, 4C) of suitable strength, causing them to lay along the perimeter web 22 on either end. The end-frame tubes/hiking stick 24 is assembled with two or four of its component lengths by use of double male unions with mid-stops 24D which are threaded into the corresponding female threads of the internally threaded sections 24C such that the assembled length(s) is/are equal to the width of the floor assembly 20 and 22 (FIGS. 1, 2, 4B, 4C). (One assembled length of 2 of the component lengths is required with the single person 3 point attachment embodiment depicted in FIGS. 4A, 4B; One assembled length of 4 of the component lengths is required for the two person 3 point embodiment depicted in FIGS. 4C, 4D; Two assembled lengths of 2 of the component lengths are required for the 4 point attachment embodiment depicted in FIGS. 1, 1A, 1B) The web loops 26 are sewn so as to snugly grip the assembled component length(s) of the end-frame tubes/hiking stick 24 after they are inserted. When not in use, two or more of the component lengths of the end-frame tubes/hiking stick 24 may be assembled by double male unions with mid-stops 24D which are threaded into the corresponding female threads of the internally threaded sections 24C to form a hiking stick of a desired length for the backpacking hiker. A top cap threaded plug 24E or cane handle threaded top 24E, rubber ground tip attached to a threaded plug 24F or threaded ice-pike threaded tip 24F, and wrist thongs 32C all as depicted in FIG. 3 may also be added to the hiking stick in various configurations. In tent use, these component lengths of the end-frame tubes/hiking stick 24 (FIGS. 1, 2, 3, 4B, 4C) form the end frames of the sleeping surface or floor assembly 20 and 22. The corner web loops 26A are attached to both ends of each assembled length of the end-frame tubes/hiking stick 24 with half-round (approximately 120 degree arc) web loop clamps 30 (FIG. 2), which are as wide as the corner web loop 26A they bind, at the top and bottom of each end of the assembled length of the end-frame tubes/hiking stick 24 with a web loop clamp bolt 32 and web loop clamp wingnut 32A as depicted in FIG. 2 protruding, by way of drilled and aligned web loop clamp bolt holes 32B (FIG. 2), through the clamps 30 and the corner web loop(s) 26A as depicted in FIG. 2 and the end-frame tubes/hiking stick 24 and holding them clamped tightly together so that the floor assembly 20 and 22 is securely held out to the ends of the end-frame tubes/hiking stick 24.

Outboard of each assembled length end-frame tubes/hiking stick 24, near its ends, opposite the floor's 20 corner web loop 26A attachment site and at 90 degrees to the web loop clamp bolt holes 32B (FIG. 2), a chain link slot 34 (FIG. 2) is provided in the end-frame tubes/hiking stick 24 and through the corner web loop 26A through the properly sized and sewn corner web loop chain link slot 34A (FIG. 2). A chain link 36 (FIG. 2) of suitable size, typically ¼", attached to a swivel-mount block 38 (FIGS. 1, 1A, 1B, 2, 4B, 4C, 4D), is inserted in the chain link slot 34 (FIG. 2) and held in place with the same web loop clamp bolt 32 and web loop clamp wingnut 32A as depicted in FIG. 2 on each end that also holds the clamps 30 which secures the corner web loop(s) 26A to the assembled length of the end-frame tubes/hiking stick 24. Then the tree lines 42 (FIGS. 1, 1A, 1B, 2, 4B, 4C, 4D), typically ½" static (non-stretch) line are rove through the swivel-mount blocks 38 (sized to match the lines) at each end of each assembled length of the end-frame tubes/hiking stick 24, one tree line 42 through both swivel-mount blocks 38 on each assembled length of the end-frame tubes/hiking stick 24. Tree lines 42 are also rove through a floating metal loose D-ring 28 (FIGS. 1, 1A, 2) slid onto the middle of the assembled length of the end-frame tubes/hiking stick 24 during its assembly into the web loops 26. The loose D-ring 28 is for additional bracing for the assembled length of the end-frame tubes/hiking stick 24, by the tree line 42 being rove through it, to keep it from deflecting in the middle of its run when under load. This featured bracing loose D-ring 28 may not be needed as stronger, lightweight materials are found for the tube such high tensile carbon fiber or titanium. The prototype used 6061, 1¼" O. D. aluminum tube and needed the center brace in order not to deflect under working loads in field tests.

To one end of one tree line 42 the tensioner 44 (FIGS. 1, 1A, 1B, 4A, 4B, 4C, 4D) is added with appropriate rigging hardware such as a karabiner or quick-link. The tensioner 44 is comprised of a block and tackle of 5 total pulley reductions, two on one end and three on the other (Other block and tackle configurations may be used as engineered; this arrangement has been quite adequate in the prototype). Static line of ¼" to 5⁄16," typically, is rove between the blocks of the tensioner 44 (also sized to match the lines) and through an instant line-locking device such as a cam cleat built onto one set of blocks (the entire arrangement is similar to the mainsheet or vang device assembly on a small sailing vessel). Then the four ends of both tree lines 42 (one having the tensioner 44 attached) are attached to the selected trees with tree-saver bands 46 (FIGS. 1, 1A, 1B, 4C). (In the 3 attachment point embodiments 2,3, one line is rove through the head end blocks just as on the 4 attachment point embodiment 1. At the foot end, the tensioner 44 is attached directly to the triangular yoke extension 48 (FIGS. 4A, 4B) of the perimeter web 22 via appropriate rigging hardware and thence led to the tree-saver band 46 and the tree.) The tree-saver bands 46 are made of the same nylon webbing as is used to form the perimeter web 22. They may be made to various lengths, typically 4' to 10', with each end turned back on itself in a flat loop of approximately four inches (flat part of working end of web laid against flat part of standing part of web) and heavily bar-stitched. The loop is to be of sufficient size to permit the band to be easily passed back through its loop. The tree-saver bands 46 may be variously configured in each individual set-up for working length and method of attachment to the tree. Tree lines 42 are then tied through one or both of the web loops of the tree-saver bands 46 as depicted in FIGS. 1, 1A, 1B.

A spring clip 40 (FIGS. 1, 1A, 2) is inserted into each end of each assembled length of the end-frame tubes/hiking stick 24 so that they clip around the web loop clamp bolt 32 (FIG. 2) that is holding the chain link 36 (FIG. 2) and clamps 30 (FIG. 2) in place. The spring clips 40 are of such a length as to protrude approximately 2" outside the end of the assembled length of the end-frame tubes/hiking stick 24, and they are to end in a formed loop. The spring clips 40 are not to be made tight fitting to the web loop clamp bolt 32, but are to have significant play in them as they are integral to the tent 56 and fly 58 structure and are to allow it to flex and work with the floor assembly 20 and 22. Fiberglass tent wand hoops 50 (FIGS. 1, 1A, 2, 4A, 4C, 4D) are to be inserted into the loop of the spring clip 40 until they come to a pre-set stopper gasket 52 (FIG. 2) around their circumference. The depth to which they pass through the spring clips 40 determines the volume of dry storage under the sleeping area as the tent 56 fly 58 (FIG. 1B) extends to the ends of the tent wand hoops 50. The tent wand hoops 50 then proceed quarter-corner such that the two tent wand hoops 50 will cross each other overhead of the middle of the floor assembly 20 and 22 (other configurations are also possible) and at the height of the tent 56 and enter the opposing spring clip 40 at the opposite end of the other side. A 2" stand-off is provided by the spring clips 40 and the tent wand hoops 50 between the fly 58 and the tent's 56 floor 20 and walls to provide an air flow space between the fly 58—the non-breathable, waterproof cover—of the tent and the tent 56 itself which is hooked to hang 2" inside the loop structure created by the fiberglass tent wand hoops 50. The fly 58 lays over the tent wand hoops 50 and a fly draw-string 54 (FIG. 1B), sewn into base seams of the fly 58, draws it taut and recurves the bottom projections of the tent wand hoops 50. It is further guyed and snugged with fly guylines 58A tied to sewn in tabs and rings 58D as depicted in FIG. 1B. In standard ground tents, guylines are staked to the ground where here, tree lines 42 and other fly guylines 58A provide anchor points to guy the fly 58 to by tying.

The tent 56 (FIGS. 1A, 1B, 2), which is of breathable fabric with zippered door/wall panels and matching zippered flexible screen 56G closures/windows according to the individual design, thence is tied by sewn-in tent corner ties 56A (FIGS. 1A, 2) or a base seam draw-string 56C (FIG. 2) to the chain links 36 (FIG. 2) which are near each corner. The tent corner ties 56A or the base seam draw-string 56C are aligned with a longitudinal seam and/or a drawstring within a double seam channel replaces the ties and the straight base seam 56B (FIGS. 1A, 2) either of which run along the straight bottom edge of the tent's 56 longitudinal side panels. Sewn below this straight base seam 56B line is a loosely fitting panel of tent material or Caternary and load sag curved panel 56D (FIGS. 1A, 2) cut to a curve in its foot, fullest at the middle of its run, to follow and allow for any Caternary or load sag to which the floor 20 may distort under load, use, and movement while allowing the tent 56 to hold its shape and place above the straight base seam 56B and/or base seam draw-string 56C. Sewn to the curved, lower edge of this fabric piece is a fabric band of hook and loop tape 56E (FIGS. 1, 1A, 2) which is to match to its mate hook and loop tape 56E (FIG. 2) that is sewn along the edge of the perimeter web 22. These hook and loop tapes 56E are also to be sewn along the edges of the perimeter web 22, thus around the whole perimeter of the floor 20. These effectively close the tent 56 to the floor 20 from insects and other intrusions, making tent 56 and floor 20 an integrated yet separable whole. Zippers or other closure devices might also be used. Shock-corded hooks 56F (FIGS. 1, 1A), sewn into the narrow tent panels and seams which are between the opening sections of the tent 56 and which are beneath the path of the tent wand hoop 50 arches, are used to hang the tent 56 to the tent wand hoop 50 arches. Again, this is typical and standard, modern tent design. Thus, the tent 56 (FIGS. 1A, 1B, 2) is erected and the fly 58 (FIG. 1B) installed over it.

Operation of the Preferred Embodiments with Reference to the Drawings

To operate the invention, an appropriate wooded site must first be chosen. For the 4 attachment point embodiment 1 as depicted in FIGS. 1, 1A, 1B, four trees (or four points—possibly more than one point in one tree) must be chosen which lie farther apart than the perimeter size of the floor assembly 20 and 22 plus minimal room for the installation of the tree lines 42 (FIGS. 1, 1A, 1B, 2, 4B, 4C, 4D) and tensioner 44 (FIGS. 1, 1A, 1B, 4A, 4B, 4C, 4D). Maximum distance is determined by the combined lengths of the tree lines 42 and the tree-saver bands 46 (FIGS. 1, 1A, 1B, 4C). Longer tree lines 42 may be used with any of the disclosed embodiments. The four points selected must form a four-sided figure though it need not be regular in its dimensions, lengths or angles, as the swivel-mount blocks 38 (FIGS. 1, 1A, 1B, 2, 4B, 4C, 4D) allow the tree lines 42 to adjust and compensate for irregularities to allow the invention to come to square.

In the 3 attachment point embodiments (single person 3 attachment point embodiment 2 as depicted in FIGS. 4A, 4B, and two person 3 attachment point embodiment 3 as depicted in FIGS. 4C, 4D), three attachment points/trees must be selected. The head end is set up as with the four attachment point embodiment 1 and then the foot end is stretched to a triangle whose point lies somewhere between the span of the two head points and at an appropriate distance from the foot end to allow for the tensioner 44 (FIGS. 1, 1A, 1B, 4A, 4B, 4C, 4D) to be installed to the triangular yoke web extension 48 (FIGS. 4A, 4B) of the perimeter web 22 (FIGS. 1, 2, 4B, 4C). As with the 4 attachment point embodiment 1, the triangle need not be regular in dimension as the swivel-mount blocks 38 and tree lines 42 at the head end will compensate and allow the invention to come to its proper shape as tension is applied.

Next, the floor assembly 20 and 22 (FIGS. 1, 2, 4B, 4C) is laid out and its hardware is assembled to it: assembled length of the end-frame tubes/hiking stick 24 24 (FIGS. 1, 2, 3, 4B, 4C) are inserted into the web loops 26 (FIGS. 1, 2, 4B, 4C). When the assembled length of the end-frame tubes/hiking stick 24 are half inserted, a loose D-ring 28 (FIGS. 1, 1A, 2) is added for deflection strength (the tree line 42 will run through this as well as through the swivel-mount blocks 38 at the ends of the assembled length of the end-frame tubes/hiking stick 24), and then the assembled length of the end-frame tubes/hiking stick 24 insertion through the remaining web loops 26 is completed. Next, swivel-mount blocks 38 are installed at the ends of the assembled length of the end-frame tubes/hiking stick 24 (except foot end of 3 attachment point embodiments 2,3) by means of inserting their swivel-mount block 38 attached chain link 36 (FIG. 2) into the chain link slot 34 (FIG. 2) in the assembled length of the end-frame tubes/hiking stick 24 (FIGS. 1, 2, 3, 4B, 4C) and corner web loop 26A (FIG. 2). Next, web loop clamps 30 (FIG. 2) are installed at the top and the bottom of the ends of the assembled length of the end-frame tubes/hiking stick 24; then the web loop clamp bolt 32 (FIG. 2) is passed, by way of the drilled and aligned web loop clamp bolt holes 32B (FIG. 2), through the top web loop clamp 30, through the underlying corner web loop 26A, into the assembled length of the end-frame tubes/hiking stick 24 by passing through the web loop clamp bolt hole 32B, through the chain link 36, then out of the assembled length of the end-frame tubes/hiking stick 24 by passing out through an opposing web loop clamp bolt hole 32B, then through the remaining layer of corner web loop 26A, and through the bottom web loop clamp 30, and then a web loop clamp wingnut 32A (FIG. 2) is installed and hand-tightened on the web loop clamp bolt 32. This preceding assembly is done at both ends and all four corners of the 4-attachment point embodiment 1, however, swivel mount blocks 38, chain links 36, or chain link slots 34 are only necessary at the head end of the 3 attachment point embodiments 2,3 as depicted in FIGS. 4A, 4B, 4C, 4D, insofar as the foot end of the 3 attachment point embodiments 2,3 come to a point and is secured for use by means of a tree line 42 tied to a loose D-ring 28 which is fitted onto the triangular yoke web extension 48 which is attached the perimeter web 22.

Next, the tree lines 42 are installed through the swivel-mount blocks 38 and their ends led toward the selected trees, branches, or other attachment points. At the trees, tree-saver bands 46 are wrapped around the trees in suitable configurations as depicted in FIGS. 1, 1A, 1B and leveled by eye accounting for grade changes in the forest floor. Leveling is temporary and can be adjusted throughout set-up and after a test use of the assembled floor assembly 20 and 22. The tree lines 42 are tied through one or both loops of the tree-saver bands 46 depending on how the tree-saver band 46 has been applied to the tree, using secure, non-jamming knots, bowlines and double half hitches, typically. The tree line 42 not using the tensioner 44 typically the head end, but not necessarily so in the 4 attachment point embodiment, is set up first to hand tightness. Then the other tree line 42 with the tensioner 44 attached to it is installed and tensioning is initiated. In the 3 attachment point embodiments 2,3 irregularities of angle are eliminated as tension is applied. If the distortion of the setting is extreme, the head end tree line 42 may need to be slacked off to allow the tensioner 44 to pull the invention to its intended shape. In the 4 attachment point embodiment 1, if wrinkles appear as tension increases, the user must push them out by hand-squaring the invention as tension is increased, rolling the invention back or forth along the tree lines 42 where they pass through the swivel-mount blocks 38 by pushing on one end or the other of the assembled length of the end-frame tubes/hiking stick 24. In all embodiments 1,2,3 as tension is increased, any unlevelness also becomes apparent. Tension is slacked-off and the appropriate tree-saver band(s) 46 is raised or lowered and tension is re-applied. In field tests this trial and error process took two or three adjustments and trial uses to complete a successful, comfortably level set-up.

For mid-day rests or in good, bug-free weather, the unit may be used now, open and without the tent.

Otherwise, the tent 56 (FIGS. 1A, 1B, 2) may be installed at the user's discretion. First, it is laid out correctly aligned on the suspended floor assembly 20 and 22 (FIGS. 1, 2, 4B, 4C). Then, the tent corner ties 56A or base seam draw-string 56C are tied to the chain links 36 (FIG. 2) as anchor points. The base of the tent 56 may also be attached by the hook and loop tape 56E (FIGS. 1, 1A, 2) to the perimeter web 22 now (or after the tent is raised). Next, the spring clips 40 (FIGS. 1, 1A, 2) are inserted into the ends of the assembled length of the end-frame tubes/hiking stick 24 and sprung onto the web loop clamp bolts 32 (FIG. 2) there. Then, the tent wand hoops 50 (FIGS. 1, 1A, 2, 4A, 4C, 4D) are assembled and put into place, inserting them to their stopper gaskets 52 (FIG. 2) at all four corners. Then a plurality of shock-corded hooks 56F (FIGS. 1, 1A), which are sewn into the tent 56 seams that underlie the tent wand hoops 50, are used to hang the tent 56 to its frame.

With the tent 56 conveniently raised off the ground, the user may have waited until now to proceed around the perimeter of the tent 56 installing the hook and loop tapes 56E (FIGS. 1, 1A, 2) together. If the user should elect not to use the fly 58 for any reason or to lift up one or both sides of it as an awning in fair weather, he should now take its fly guylines 58A and hook them from about the mid point of each tent wand hoop 50 to the closest, adjacent tree line 42 at an angle and length to tension the tent 56 to its intended shape. These light fly guylines 58A as depicted in FIGS. 1, 1A, 1B are typically ⅛" static line, which may employ a simple line tensioner near where they are wrapped around the tree lines 42 for easy tensioning; a small hook may be used on the tent wand hoop 50 end of the fly guyline 58A which then may be hooked to the tent wand hoop 50; or the fly guyline 58A may be wrapped around the tent wand hoop 50 itself and tied—varying as particular set-up requirements vary. Also, when the fly 58 is not in use or full use, a similar fly absent draw-string 54A (FIG. 1) must be installed around the perimeter of the ends of the tent wand hoops 50 to tension and recurve them; when the fly 58 is in place its fly draw-string 54 does this. Further simple and practical adjustments may be done in the field for using these small diameter fly guyline(s) 58A to maximize stability and shape of the invention.

In the 3 attachment point embodiments 2,3, an additional yoke guy 58E (FIG. 4A) is added between the runs of the tree line 42 at the head end to affix the fly 58 as depicted in FIG. 4A. A sufficient plurality and length of guy/shock cords are to be provided for the design requirements of each embodiment.

To fully install the fly 58 (FIG. 1B) over the tent 56 (FIGS. 1A, 1B, 2) and its tent wand hoops 50 (FIGS. 1, 1A, 2, 4A, 4C, 4D), properly orient the fly 58 so that the fly slots 58B (FIG. 1B) with hook and loop fasteners 58C (FIG. 1B) in the corners of its bottom section fit around the swivel-mount blocks 38 and tree lines 42. The fly slots 58B are closed with their respective hook and loop fasteners 58C after they are fit around the tree lines 42. The fly draw-string(s) 54 (FIG. 1B) in the fly's 58 base seam are joined and tensioned to draw in the protruding bottom ends of the tent wand hoops 50 and thence to snug down the fly 58. Finally, the fly's 58 fly guylines 58A are attached to sewn-in tabs and rings 58D (FIG. 1B) over where the fly's 58 seams lay on their tent wand hoops 50; the fly guylines 58A are then affixed to their respective tree lines 42 and are tensioned as needed. For weatherliness, the fly 58, unlike the tent 56 under it, has only one opening at the head end of each embodiment. This flap opening may have a weatherlapped closure device, zipper, hook-and-loop fastener or tape, or tie-string as particularly embodied.

In fair weather, the fly 58 can be loosed on any side or all sides and guyed out to be a porch or full sunshade in any or all of its directions. Then any of the tent's 56 four opening walls so uncovered can be used as doors or windows. The fly guylines 58A in this case must also be moved back onto the tent wand hoops 50 to secure the tent 56.

II. Most Preferred Embodiment

Without the Hiking Stick Apparatus

Figure 5A:
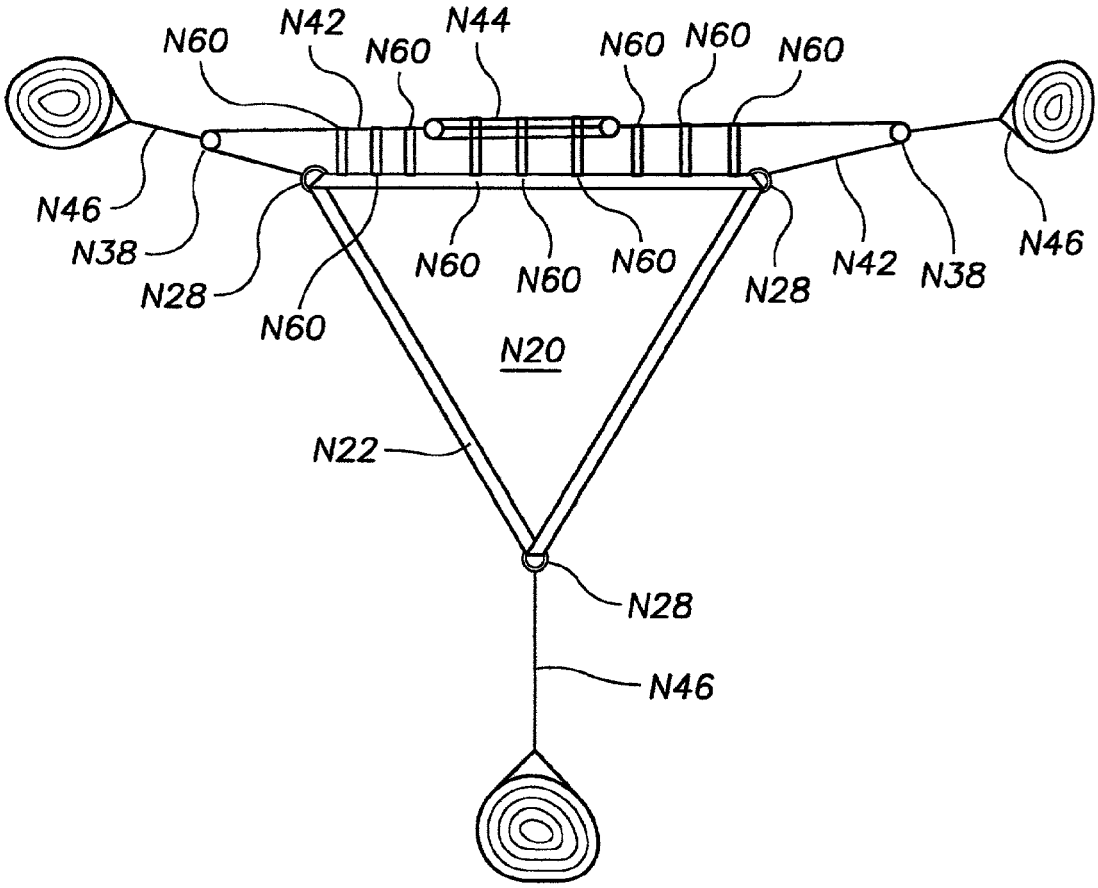
FIG. 5A depicts a top view of the most preferred embodiment two person three point attachment embodiment for use without a hiking stick reinforcement.
Figure 5B:
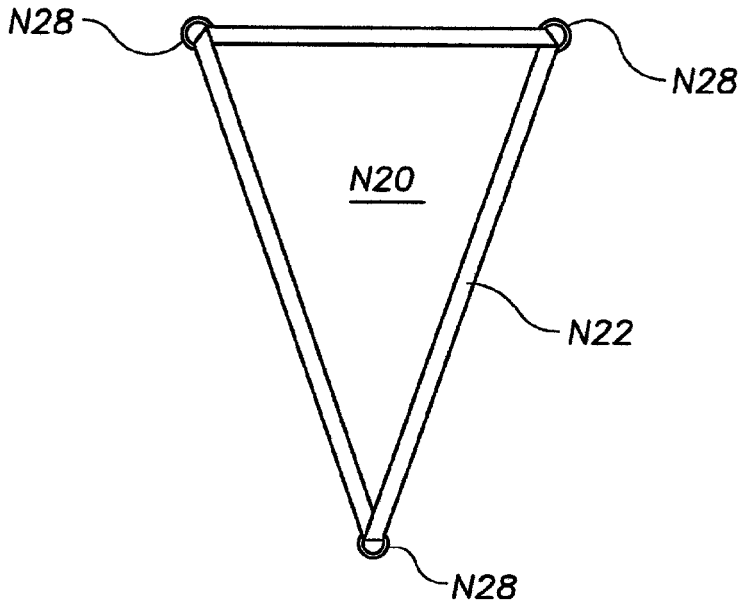
FIG. 5B depicts a top view of the most preferred embodiment one person three point attachment embodiment for use without a hiking stick reinforcement.
Figure 6A:
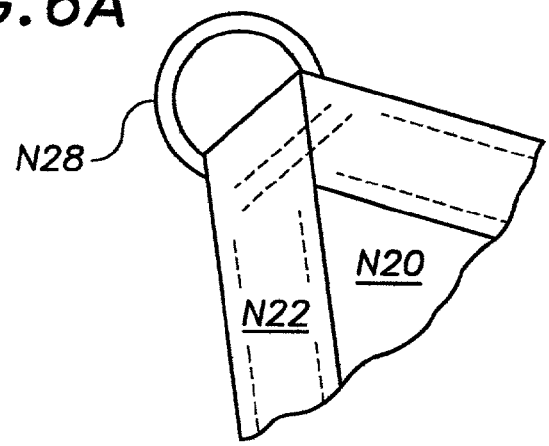
FIG. 6A is an exploded top view of the assembly elements of one of the corners of the most preferred embodiment three point attachment embodiment.
Figure 6B:
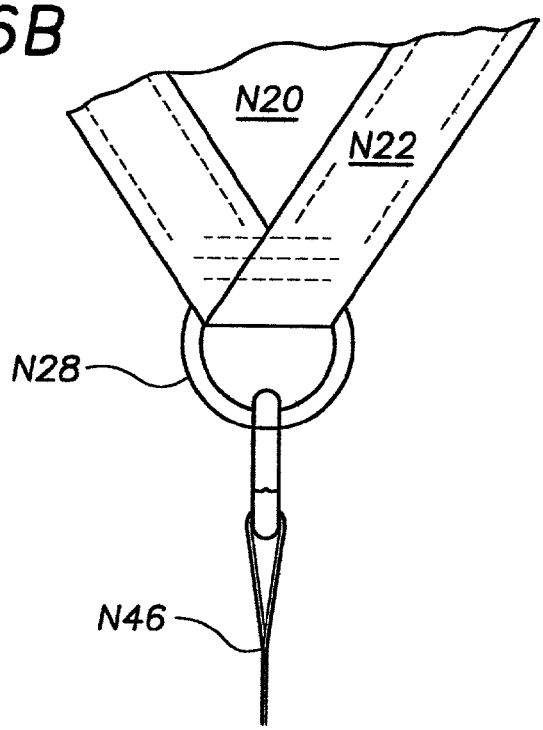
FIG. 6B is an exploded top view of the assembly elements of one of the corners of the most preferred embodiment three point attachment embodiment with a tree saver band attached.
Figure 6C:
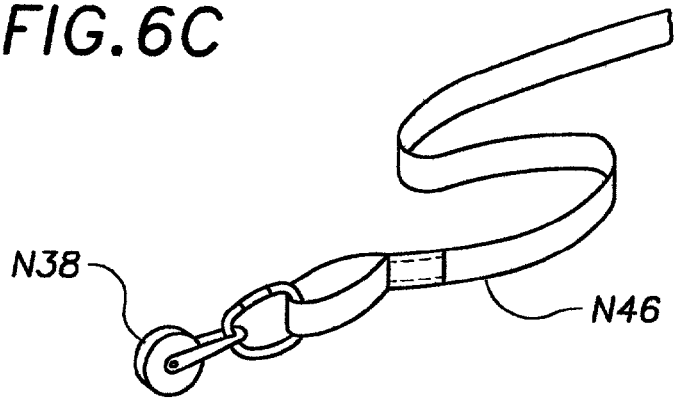
FIG. 6C is an exploded perspective view of the elevated tensioned sleeping surface end of the one of the tree saver bands of the most preferred embodiment three point attachment embodiment with a block attached.

With reference now to the drawings, and in particular to FIGS. 5-6 thereof, a new and novel apparatus and method of use of the apparatus for the most preferred embodiment of a suspended sleeping surface embodying the principles and concepts of the present invention and generally designated by the reference numeral N20 in FIGS. 5A, 5B, 5C, 6A, 6B, 6C.

List and Description of:

General Description of Reference Numerals in Drawings

Numbers preceded by a capital "N" refer to items, fixtures, hardware, or details in the most preferred embodiment. All other numbers are the same as in the Co-Pending application Ser. No. (09/494,259) and are depicted as the preferred embodiment detailed above.

General Terms

The most preferred embodiments depicted in FIGS. 5(A-C) and 6(A-C) arise primarily from improvements in the sleeping surface assembly of the preferred embodiment and its tensioning methods and devices. This most preferred embodiment assembly, with its permanently attached features and devices, shall be generally called "The Tensioned Sleeping Surface," hereinafter the TSS N20. For purposes of this specification; particular parts of the TSS N20, when needed to be separately identified, shall incorporate features of the preferred embodiment and hence will continue to be named and numbered by the preferred embodiments' nomenclature as depicted in FIGS. 1-4.

The "Head" or "Head End" of the TSS N20 shall be the side to whose two ends the two Tree Lines (FIGS. 1, 1A, 1B, 2, 4B, 4C, 4D, no. 42; compare FIG. 5A, no. N42) are attached and led by way of Blocks (FIGS. 1, 1A, 1B, 2, 4B, 4C, 4D, no. 38; compare FIG. 5A, no. N38) now attached to the Tree-Saver Bands (N46 in FIG. 5A and FIG. 6B) to share the same Tensioning device or Tensioner (FIG. 1, 1A, 1B, 4A, 4B, 4C, 4D, no. 44; compare FIG. 5A, no. N44). The "Head" or "Head End" is also the side toward which the sleeper(s) head(s) is/are intended to be toward during reclining and sleep. The "Foot" or "Foot End" shall be the opposing apex angle and corner on a Three-Point Embodiment, or end on a Four-Point Embodiment, the remaining sides being called "Sides. " Individual elements, parts, and details will continue to be described by their own names and numbers.

In the "Operation" section of this most preferred embodiment specification (or wherever it occurs), the geometric term "Altitude" shall refer to an imaginary line drawn from the midpoint of the Head End (which is the geometric Base of the triangle) at ninety degrees from it to the opposing apex which is the Foot End. The visual projection of this line beyond the Foot End apex to approximate ninety degrees, and the conformity of the Foot End Tree-Saver Band (FIG. 5A, no. N46) and attachment point to this line, is essential to successful set-up of the most preferred embodiments in the field.

The "Caternary/Load/Movement Sag Panel" 56D as depicted in FIG. 2 hereinafter the CLM Sag Panel 56D, is a section of tent cloth attached below the straight base seam of the tent 56 which stretches from corner to corner of each side along the outside perimeter of the TSS N20. The CLM Sag Panel 56D is straight along its top edge, and sewn to the base seam, but its bottom edge is formed into a downward curve, fullest at the middle of its run—the middle of the tent 56 and TSS N20 side—so that it can allow the TSS N20 to flex under use, either from any natural Caternary sag or under movement or load, without the TSS N20 becoming detached from the tent 56. The use of the CLM Sag Panel 56D occurred along the long sides of the original Embodiments and was not needed on the ends supported by End Frames 26, but the CLM Sag Panel 56D is needed on all sides of the larger equilateral triangular shape as depicted in FIG. 5A or the isosceles triangle Embodiments as there are no End Frames 26, but may not be needed on the isosceles triangle embodiments where the Head End is short, such as the "Bivy" Embodiment as depicted in FIG. 5B.

The development of the most preferred embodiments led to the elimination of the End Frames 26 and their elements (FIGS. 1, 2, nos. 24, 26, 26A, 28, FIGS. 4B, 4C), and also the elimination of the Hiking Stick (FIG. 3, all numbered parts) which is a secondary use of the End Frames 26 when not in their use as End Frames 26.

The D-ring of the preferred embodiment, (FIGS. 1, 1A, 2, no. 28), as an End Frame Brace is eliminated in the most preferred embodiment. But the same type and size D-rings N28 are now used as corner attachments (FIGS. 4B, 4C, no. 28; compare FIGS. 5A, 5B, 6A, 6C, no. N28), sewn into the web N22 at the three corners of the TSS N20.

The End Frame Blocks depicted in the preferred embodiment (FIGS. 1, 1A, 1B, 2, 4B, 4C, 4D, no. 38) and their various attaching hardware and details (FIG. 2, nos. 30, 32, 32A, 32B, 34, 34A, 36, 40) are also eliminated in the most preferred embodiment. The Tend Wand Hoops (FIG. 2, no. 50) attach to the outboard edge of the corner D-rings (FIGS. 5A, 5B, 6A, 6C, no. N28). Tent Comer Ties (FIG. 2, 56A,C) are also to be tied to the D-rings N28 inboard of the Tent Wand Hoop (FIG. 2, no. 50) attachment site.

The End Frame Blocks (FIGS. 1, 1A, 1B, 2, 4B,4C,4D, no. 38) of the preferred embodiment are replaced by two similar blocks (FIGS. 5A, 5B, 6B, no. N38) in the most preferred embodiment, achieving the same purpose, and attached by simpler means and hardware (a carabineer or quick-link, typically), one Block N38 to each Head End Tree-Saver Band N46. The use of this Block N38 allows the TSS N20 to be adjusted to its designed, geometric shape despite the asymmetries of the forest setting—trees/attachment points, as opposed to the preferred embodiment which does not form as exact the geometric shapes as the TSS N20 Embodiments.

For the sake of ease of assembly for the user, the Tree Lines (FIGS. 1, 1A, 1B, 2, 4B, 4C, 4D, no. 42) of the preferred embodiment are now coincidentally improved to be left relatively permanently attached to the Tensioner (FIGS. 1, 1A, 1B, 4A, 4B, 4C, no. 44) by means of eye-splicing one end of each of them to the becket or shackle-like assembly built into each of the block assemblies that comprise the ends of the Tensioner 44. This eliminates the need for tying two extra knots in the set-up to link the Tree Lines 42 to the Tensioner 44. If it is desired to easily separate the Tree Lines 42 and the Tensioner 44 for packing or other reason, a carabineer or other quick-link attachment may be used between the eye-splice and the block attachment point; however, there is no other need to separate the Tree Lines 42 from their Tensioner 44, and they may be left as one unit if desired. In the most preferred embodiment, the Tree Lines will thus change nomenclature from 42 to N42, and the Tensioner will also change from 44 to N44. Reference will be made to them separately by their new numbers or jointly as N42/44.

The UNIQUE and NOVEL elements of the most preferred embodiments BEYOND the preferred embodiments (and not dis-including any and all remaining pertinent elements cited in the description of the preferred embodiment) are: the TSS N20, the rigid tensioning, WITHOUT ANY PERMANENTLY RIGID FRAME as is the preferred embodiments of this invention, of an equilateral or isosceles triangle of cloth (FIGS. 1, 2, 4B, 4C, no. 20) of sufficient strength to bear human weight in a camping and sleeping mode, said cloth being bounded by static (no stretch), high strength webbing (FIGS. 1, 2, 4B, 4C, no. 22 compare 5A, 5B, 6A, 6C, no. N22) which is set up to a rigid, frame-like state by first affixing the Foot End apex to a Tree-Saver Band (FIGS. 1, 1A, 1B, 4A, 4C, no. 46 compare 5A, 6B no. N46) and its anchoring tree or attachment point at approximately ninety degrees to the projected Head End alignment, and then applying tension along the Head End of the triangle causing the entire TSS N20 to come into suitable tension along all its sides and angles (as described in the "Operation" section of this Specification). The Head End is tensioned by outward force being applied equally to both its ends by way of the two opposing Tree Lines FIG. 5A, no. N42 passing through the Blocks N38 at their respective Tree-Saver Bands N46, and thence turning back toward each other to join a centrally positioned Tensioner (FIG. 5A, no. N44). As tension is applied, the Head End can be moved back and forth laterally via the Tree Lines N42 moving through their respective Blocks N38 so that the ninety degree angle between the Head End (Base of the triangle) and the Altitude can be achieved, and the TSS N20 set up to its designed shape and tension.

Elements of NOVELTY in creating a tent 56 structure to erect on the TSS N20 REMAIN THE SAME as in the preferred embodiment except for minor hardware and detail accommodations from Embodiment to Embodiment. These elements are:

1). The corner ties (FIG. 2, nos. 56A,C) to secure the tent to the TSS N20 at the corners' D-Rings N28. These ties are attached to a straight base seam or seam channel (FIG. 2, no. 56B) which lies along the straight base line of the tent sides, the CLM Sag Panels 56D extending below said straight line. The corner ties serve to affix the tent tightly at the corners' D-Rings N28 of the TSS N20 and allow the base seams of the tent 56 to be drawn tight.

2). The hook and loop tapes (FIG. 2, no. 56E), or other closure systems, affixed, respectively, around the perimeter of the TSS N20 and of the tent base's edges (corner's and CLM Sag Panel 56D edge's) so that the two can be joined along their edge runs upon erecting the tent upon the TSS N20, joined to permit the exclusion of insects and wind as are common purposes of tents, but NOVEL in that modern camping tents, or tents in general, have no specific or similar need for the floor and the sides to be separate before set-up nor need for CLM Sag Panels 56D.

3). The CLM Sag Panels 56D are sewn (and/or partially zippered—see Postscript description of recent design developments) along the base seams of the tent 56 walls to allow for Caternary sag as well as for load and movement sag to occur without disconnecting the tent 56 from its TSS N20 base/floor along the side runs. The CLM Sag Panels 56D remain the same except that in the most preferred three-point-attachment Embodiments, a CLM Sag Panel 56D is used on all sides of an equilateral triangle or large-base isosceles triangle Embodiments, including the Head End, because there is no longer a rigid, aluminum endframe (FIGS. 1, 2, 4B, 4C, no. 24) in use there. In a small, one-man "Bivy" Embodiment (FIG. 5B), where the isosceles base, serving as the tensioned, Head End, is short, typically three feet, a CLM Sag Panel 56D may not be needed.

Description of Most Preferred Embodiment—Reference FIGS. 5A, 5B, 6A, 6B, 6C Pertinent changes and details of the Most Preferred Embodiments TSS N20 are illustrated in FIGS. 5A, 5B, 6A, 6B, 6C showing:

FIG. 5A: An overhead view of the two-person TSS N20 Embodiment in its set-up mode FIG. 5B: A proportion drawing from the same view of the "Bivy" TSS N20 Embodiment FIG. 6A: Comer Detail of the TSS N20 with D-ring N28 sewn in FIG. 6B: Attachment Detail of Block N38 to Tree Saver Band N46 at Head End FIG. 6C: Attachment Detail of Tree Saver Band N46 to Foot End with carabineer typified Numbers N28: D-ring (FIG. 2, no. 28) in the preferred embodiments is used in the most preferred embodiment as an integral corner attachment for the TSS N20. Compare (FIG. 4B, 4C, no. 28) with new sole use in (FIG. 5A, 5B, 6A, 6C, no. N28).

N38: Blocks (FIGS. 1A, 1B, 2, 4B, 4C, 4D, no. 38) in the preferred embodiments are used in the most preferred embodiment when attached to Head End Tree-Saver Bands N46 with significant hardware attachment reductions to one simple and single link of attachment to Tree-Saver Band N46. The purpose of allowing shape adjustment of the TSS N20 and accommodation to the asymmetrical forest setting is retained.

N42: Tree Lines (FIGS. 1, 1A, 1B, 2, 4B, 4C, 4D, no. 42) in the preferred embodiments are used in the most preferred embodiment with an eye-splice in one end, subsequently semi-permanently attached to the Tensioner N44, one to each respective end.

N44: The Tensioner or Tensioning device of the most preferred embodiments (FIGS. 1A, 1B, 1C, 4A, 4B, 4C, 4D, no. 44; compare FIG. 5A, no. N44) remains the same as in the preferred embodiments, but tension is now applied simultaneously to both Tree Lines N42 as illustrated in FIG. 5A. With proper length set-up of the Foot End Tree-Saver Band (FIGS. 5A, 6C, no. N46) (as described in the "Operation" section), the Tensioner N44 will tense not only the Head End but also the Foot End and the remaining Sides.

N42/44: N42 and N44 where regarded as one unit.

N60: Head Ties are used specifically to eliminate the need for the "stiffening" end-frame tubes/hiking stick 24 (FIGS. 1-4) by providing an appropriate amount of "stiffening" of the ends of the most preferred embodiments without the hassle of assembly of the end-frame tubes/hiking stick 24 into the sleeping platform or the additional pack weight represented by the end-frame tubes/hiking stick 24.

Description of Most Preferred Embodiment—FIGS. 5-6, Detail Reference Numbers N20-N60

N20 (FIGS. 5A, 5B, 6A, 6B) TSS (Tensioned Sleeping Surface—Most Preferred Embodiment)

N22 (FIGS. 1, 2, 4B, 4C) Perimeter Webbing—Most Preferred Embodiment N28 (FIGS. 5A, 5B, 6A, 6B) D-Ring—Most Preferred Embodiment N38 (FIGS. 5A, 6C) Block—Most Preferred Embodiment N42 (FIG. 5A) Tree Line—Most Preferred Embodiment N46 (FIGS. 5A, 6B, 6C) Tree Saver Bands—Most Preferred Embodiment N60 (FIG. 5A) Head Ties—Most Preferred Embodiment Detail Description The Most Preferred Embodiments are similar to the Preferred Embodiments with the exceptions noted in the preceding text and the above listed drawings and numbers. Tree Lines (FIG. 5A, 6A, 6C, No. N42) are now supplied for the Head End corners only (two in number) as tying appropriate knots in them at lengths where they attach to the D-Rings (FIG. 5A, no. N28) of the Head End of the TSS N20, provides the chief means by which the TSS N20 may be set up in a wide variety of tree attachment spacings in the asymmetrical forest setting. The Tree Lines (FIG. 5A, no. N42) extend outward from their respective D-ring (N28) attachments until they arrive at the Blocks (FIG. 5A, no. N38) attached to the Tree-Saver Bands (FIG. 5A, no. N46) of the two trees chosen for the Head End of the TSS N20. Here they rove through the Blocks (N38) and turn back to join the Tensioner (N44) from both ends respectively. Under tension, it is intended to draw the outbound Tree Lines (N42) (proceeding away from the TSS N20 and the inbound Tree Lines (proceeding toward the Tensioner) (N44), into a near parallel alignment. This same tensioning is intended to apply all necessary tension to the Foot End and its attachments to its selected tree (as described in the "Operations" section). The Foot End is supplied only with a Tree-Saver Band (N46) and its hardware linkage, and this Band provides a second but smaller degree of adjustment to the forest setting, the Foot End Tree-Saver Band (N46) being installed to an approximately correct length (slightly shortened to be effected by the tensioning) before tensioning commences on the Head End.

Lateral adjustments through the Blocks (N38) after initial tensioning are intended to bring the TSS N20 to its proper shape, allowing for an approximately ninety degree angle between the projected line of the Head End and the projected line of the Altitude through the Foot End apex.

Leveling the TSS N20 to comfort and assembly of the Tent 56 (typified by FIG. 1B), the Fly 58 (typified by FIG. 1C), and any other accouterments is similar to the descriptions of the Preferred Embodiments.

The final "stiffening" of the Most Preferred Embodiment is accomplished by drawing tight around the Head End Tree Lines N42 the Head Ties N60 and tying them with an appropriate releasable knot for later disassembly. The Head Ties N60 are designed to replace the end frame/hiking stick 24 used as a "stiffening" means in the preferred embodiments.

Operation of the Most Preferred Embodiments of the Invention with Reference to the Drawings To operate the Most Preferred Embodiments, an appropriate wooded site must first be chosen; three attachment points must be selected. These attachment points (trees, branches, or other) must be far enough apart to allow for the TSS N20 to be laid out on the forest floor with at least several feet beyond each of its corners for the Tree-Saver Bands (N46), Tree Lines and Tensioner (N42/44), and their hardware to be installed and allowed to function correctly. Maximum set-up distances are regulated by the combined total lengths of the Tree-Saver Bands (N46) at maximum extension and the Tree Lines (N42) at maximum extension. Ideally, attachment points which create a triangle that approximates the shape of the TSS N20 will be found.

However, the wider the spacing of the attachment points for the Head End, the more adjustment is available to bring the Altitude to the desired ninety degrees for the Foot End attachment. Thus, if the Foot End attachment point does not form an equilateral triangle with the Head End attachment points, the Head End can be laterally adjusted by moving the attached Tree Lines (N42) through their Blocks (N38) until the ninety degree angle is achieved or suitably approximated.

With the TSS N20 laid out on the forest floor, the Foot End attachment is made via a Tree-Saver Band (N46) and hardware link to the selected tree. These Bands will be supplied, typically, at eight foot lengths. Typically, the Tree-Saver Band (N46) is passed around the tree and then one end loop of the Tree-Saver Band (N46) is passed through the other. When snugged down to the tree, the junction of the Tree-Saver Band (N46) and its own retaining end loop may be positioned to any appropriate spot around the circumference of the tree. Here, under tension, it will stay. This is an initial way of adjusting overall length to the TSS N20 Foot End apex corner. The Tree-Saver Band (N46) may also be wound around the tree as many times as necessary to shorten it. Under tension, its flat wraps grip the tree and do not tend to slip. Between these two adjustment methods, fine tuning of length is easily accomplished. With this set-up method in field trials, one Band has been adequate to make up most required set-up lengths. Other lines or linked Bands could be used if more length was needed.

This Foot End attachment should be made at such a length so that the line of the Head End falls somewhat short of a line struck between the selected Head End attachment points. This shortfall should typically be one to two feet and provides tension to the Foot End and the other two Sides as the Head End is tensioned. This shortfall is a distance that must be ascertained experimentally in the field and in each set-up situation, and it is influenced by such factors as the distance between the Head End attachment points. Field trials have shown that an intuitive "feel" for this shortfall is quickly found in a given setting.

After this, the Tensioner, at its full extension, and Tree Lines (N42/44) are laid out in a line between the two selected Head End attachment points. Tree-Saver Band (N46) are fitted to each attachment point for the Head End, adjusted for length as needed and leveled by eye, and a Block (N38) is attached to each by an appropriate hardware link, typically, a carabineer. The Tree Lines (N42) are led to each of these Blocks (N38) respectively, rove through them, and returned toward the D-Ring (N28) of each respective Head End corner. Here, a single assembler must approximate the fmal layout of the TSS N20 between its three attachment points, then tie off one Tree Line (N42) to its respective D-Ring (N28) with a bowline knot stirrup, proceed to the other Head End end, pull the other Tree Line (N42) to a hand tautness through its D-Ring (N28), thus lifting the unit off the ground and to its approximate height and level, and then the assembler must tie off the second Tree Line (N42) to its D-Ring (N28) with another bowline. Two assemblers would work together to hand tension and square the TSS N20 at this point and to tie-off to the D-Rings (N28) simultaneously, or one holding tension while the other ties and vice versa.

Bowline knots will not jam under tension and can be easily untied when the tension is released and so are used to attach the Tree Lines (N42) to the Head End D-Rings (N28), but they can be difficult to tie in the middle of a line or in a line under any tension, even hand tension. A diagram for tying a bowline knot and one for tying a "bowline on a bight" (in the middle of a line rather than at an end) will be included in an owner's manual. A double half hitch or similar knot, which can be drawn down under tension while it is being tied, can also be used, perhaps only in the final knot. These knots, while easy to tie under hand tension, can jam under increased tension, such as that applied by the Tensioner (N44), and become difficult to untie when tension is released, but they are simpler to tie in such use than a bowline. A small marlinespikefid could be provided to assist in releasing these knots after tensioned use. A device to replace these bowline knots which will hold a line securely at a selected length and allow it to be hooked to the D-Ring (N28) or another suitable knot is currently being sought from mountaineering, rescue, safety-harness, and nautical hardware and methodologies.

With the TSS N20 now under hand tension, the Tensioner (N44) is applied to bring the unit to full, serviceable tension. During this process, any "squaring up" to ninety degrees between the Altitude and the line of the Head End is completed by moving the whole rig of the Head End and tensioned lines back or forth laterally through the Blocks (N38), and, then, full tensioning is completed. The Head End is now "stiffened" by drawing the Head Ties (N60) tightly around the Tree Lines (N42) and securing them with a releasable knot giving the head end the desired "stiffness" or rigidity similarly accomplished in the Preferred Embodiment by the End Frame/Hiking Stick (24 in FIGS. 1-4).

After the TSS N20 has "settled in" under load, additional tensioning and positioning can be done as needed. Leveling changes can also be made at the Tree-Saver Band (N46), but tension must be greatly eased to accomplish this. A final degree of tension MAY be added by using any spare line left after the D-Ring (N28) knot to lay over the Tree Lines (N42) at or near the Tensioner (N44) to draw the two ends of the Tree Line (N42) tightly together, binding them together with such as a clove hitch which is a double half hitch over a standing part (the bound lines) or other constricting knot. Any remaining Tree Line (N42) excess may be coiled and hung at any appropriate spot on the invention.

Thus, The TSS N20 is readied for the Tent 56 (typified in FIGS. 1, 1A), the Fly 58 (typified in FIG. 1B), and ready for any other accouterments to be added and for use to commence as is cited in the Preferred Embodiment. If the TSS N20 is at a working height from the ground level, these may be done standing alongside it; if it is set higher in the trees, these may be accomplished from the platform of the TSS N20 itself.

Postscripts

Other tensioning methods have been and will continue to be considered. Because of these evolvements of tensioning, a second tensioner at the Foot End, once anticipated, has not been needed. It could be added in certain large Embodiments. Web ratchets, as typified by commercial trucking tie-downs, could be incorporated into the Tree-Saver Bands (46, N46), or otherwise, thus eliminating other tension devices. The Head End Tree Line (42, N42) could be tensioned as one single line, and then the TSS N20 positioned along it and locked in place with rope clutches attached to it at each corner of the Head; a prototype of this method was successfully field tested. To date, however, the method exemplified in the Most Preferred Embodiment, has served as the simplest, most efficient, and most weight-effective method, and serves to tension the whole TSS N20 at once while allowing for its lateral adjustment, "squaring,"

in the setting. But neither the invention's scope nor the claims of the patent should be considered to be narrowed by this method.

Leveling all Embodiments is done first by eye, and then by "feel" for comfort. Leveling is done by raising or lowering appropriate Tree-Saver Bands (46, N46). Comfort and the "feel" of level are obviously more important than any mathematical leveling. Longer runs of Tree Line (42, N42) and Tree-Saver Band (46, N46) combinations may have to be raised higher at their attachment points than shorter ones to achieve the feeling of level comfort.

Additional accouterment ideas that have arisen with development:

A strap or line to be temporarily installed and tensioned under the cloth floor of the TSS N20 along the Altitude line to separate the sleeping area into two personal berths so that two users do not roll together unwanted during sleep.

A summer-use mesh floor Embodiment for coolness of use. A "no-see-um" cloth mosquito panel to be hung several inches under this and attached by the same hook and loop system that would be used to install the underslung insulation blanket for winter use as mentioned in the Preferred Embodiment.

Recent working developments in CLM Sag Panel (56D) design indicate that it may be best constructed of a stretch fabric with a shock cord installed in a seam channel along its top, straight edge; the shock cord intended to surface from its seam channel near the ends of the Panel via a grommet opening at each end, there to be tied off with a stopper knot ("figure 8" knot) so that it could be replaced or adjusted as needed. Above this seam channel, half of a zipper would be installed along the same length as the shock cord, stopping approximately four to six inches before each corner of the tent is reached, the CLM Sag Panel (56D) and Tent (56) sides being sewn together as one seam for the last several inches of their run together to each Tent (56) corner. The other half of this zipper would be sewed along the same length of the adjoining tent side panel bottom edge. This would serve as a part of the design of the opening features—doors, or with "no-see'-um" cloth zipped in place, windows, of the tent, the design intent being that all sides of the tent would be so equipped so that any of them could be used as doors or windows. The shock cord and elastic cloth of the CLM Sag Panel (56D), then, would serve to give way, without pulling on the rest of the tent, when a user of the tent, entered or exited over the unzipped CLM Sag Panel (56D) Tent 56 side junction. Upon closing this zipper, the tent wall and CLM Sag Panel (56D) would be joined together. Other zippers would continue the work of providing an open door or window as they proceeded in placement around the circumference of the intended door or window area Scope of Invention Thus the reader will see that the present invention provides a stable, secure, level, comfortable, and weathertight wilderness sleeping system and shelter, an alternative to the ground tent or the covered hammock for the wilderness hiker, backpacker, and camper, an alternative lightweight enough for the backpacking sport, ecologically sound and improved over prior art methods and systems, and not dependent on ground conditions for comfort, levelness, stability, or weathertightness. Because of its adaptable and equalizing principles, sites are nearly as easily found as for two attachment point hammocks, and in the preferred embodiment it provides a hiking stick, useful in itself in the sport and useful as a reduction in overall pack weight of the invention, a factor of major concern to the backpacker.

While my above descriptions of the invention, its parts, and operations contains many specificities, these should not be construed as limitations on the scope of the invention, but rather as exemplifications of present embodiments thereof. Many other variations are possible, for example, other embodiments, shapes, and sizes of tents can be constructed to fit on and work with a base designed to work by the principles of the present invention; various forest colors and camouflages can be employed in the unit's design that would provide interesting embodiment differences to users including such practical designs as would camouflage the unit as a hunting blind or wildlife observatory; or aesthetic designs such as an oriental rug motif for the floor print of a embodiment called "The Flying Carpet," etc. Larger sizes, for at least a two person tent, remain within projected weight ranges for one or two backpackers to carry also. Also, each embodiment can be successfully used in a variety of configurations, to wit, as an open lounging area without the tent, or with the tent but with fly guyed out as a porch or sunshade, or with the fly snugged down against foul weather.

Pack weight and pack bulk will also remain mutable ramifications with the design intent being to reduce both as much as possible with further engineering. Limiting factors include keeping a strong web frame as the unit essentially lashes smaller trees together as one unit in a wind; also, rigidity of the bed floor frame is dependent on being able to tension it sufficiently, but weight reductions may be accomplished by using lighter weight fabrics in the floor surface, and by using lighter weight end frame/hiking stick in the preferred embodiment or as in the most preferred embodiment replacing the end frame/hiking stick with a "stiffening" means such as a plurality of ties. The preferred embodiment successfully used 6061 aluminum tubing for the end frame/hiking stick, but lightweight, high strength carbon fiber tubing may be engineered later. Also, such improvements may eliminate the need for the loose D-Ring 28 (FIGS. 1, 1A, 2) brace.

Additional accessories are envisioned as specific embodiments and improvements of the basic embodiments of the invention. Clip-on rain/drip diverters for the tree lines just before they enter the blocks, storage netting and hangers for the underfloor, fly-extension-protected storage area, and underhung insulation blankets for the floor are specific accessory embodiments. Safety and access features and items for high-off-the-ground use—in the new sport of Recreational Tree Climbing—and other camping and wilderness accessories, designed for use with this specific invention, are intended to form an accessory product line around the invention.

Accordingly, the scope of the invention should be determined not by the embodiments illustrated, but by the claims and their legal equivalents which accompany this application as follows.

What is claimed as being new and novel and desired to be protected by Letters Patent of the United States is as follows:

1. A suspended sleeping surface comprising:

a floor having a head end and a foot end;

a hiking stick which is further comprised of two or more sections removably attached together to form an assembled length of the hiking stick;

the head end of the floor being removably attached to one or more of the removably attached sections of the hiking stick;

the foot end of the floor being removably attached to one or more of the removably attached sections of the hiking stick;

at least two suspension means removably attached to both the head end and the foot end removably attached sections of the hiking stick and the suspension means being further removably attached to a tensioning means and the suspension means being further removably attached to user selected stable objects located in the area where the suspended sleeping surface is being set up.

2. The suspended sleeping surface as described in claim 1 further comprising:

one or more tent wand hoops removably attached to the removably attached sections of the hiking stick;

a tent enclosure removably attached to the tent wand hoops;

a fly weathershield removably attached to the tent wand hoops made of suitable moisture resistant material and removably attached such that the fly weathershield protects the tent enclosure from moisture, the floor and a space beneath the floor but above the ground and the fly weathershield is further removably attached such that the fly weathershield is suspended over the tent enclosure and the floor permitting air to pass there between.

3. The suspended sleeping surface as described in claim 2 wherein the suspension means is removably attached to an attachment means wherein the attachment means and not the suspension means is removably attached to user selected stable objects located in the area where the suspended sleeping surface is being set up.

4. A method of using the suspended sleeping surface as described in claim 3 comprising the steps of:

removably attaching one or more of the sections of the hiking stick together forming at least two separate assembled lengths such that each of the two separate assembled lengths of the sections of the hiking stick is equal to the width of the head end and the foot end of the floor;

removably attaching one each of the assembled lengths of the sections of the hiking stick to the head end and to the foot end of the floor;

removably attaching at least two of the suspension means to the head end removably attached assembled lengths of the sections of the hiking stick;

removably attaching at least two of the suspension means to the foot end removably attached assembled lengths of the sections of the hiking stick;

removably attaching the suspension means to the tensioning means;

removably attaching the attachment means to user selected stable objects located in the area where the suspended sleeping surface is being set up;

removably attaching the suspension means to the attachment means;

applying tension which is transmitted through the suspension means to the floor by use of the tensioner;

adjusting the attachment means at one or more of the points where the attachment means is removably attached to the stable objects located in the area while applying tension to bring the floor to a flat and level position as the tension is applied;

applying additional tension transmitted through the suspension means to the floor by use of the tensioner once the floor is leveled and flat such that the floor is taut and able to support one or more users to minimize sagging;

removably attaching the tent enclosure to the assembled lengths of the hiking stick;

stabilizing the tent enclosure by removably attaching and tightening to the tent enclosure one or more stabilizing means which is further removably attached to the suspension means; and removably attaching the fly weathershield to the assembled lengths of the hiking stick whereby the fly weathershield is suspended above the tent enclosure and the floor allowing air to pass there between and further protect the tent enclosure and the floor from moisture.

5. The suspended sleeping surface as described in claim 1 wherein the suspension means is removably attached to an attachment means wherein the attachment means and not the suspension means is removably attached to user selected stable objects located in the area where the suspended sleeping surface is being set up.

6. A suspended sleeping surface comprising:

a floor having a head end and a foot end;

a hiking stick which is further comprised of two or more sections removably attached together to form an assembled length of the hiking stick;

the head end of the floor being removably attached to one or more of the removably attached sections of the hiking stick;

at least two non-tensioning suspension means removably attached to the head end removably attached sections of the hiking stick and the non-tensioning suspension means being further removably attached to user selected stable objects located in the area where the suspended sleeping surface is being set up;

at least one suspension means removably attached to the foot end of the floor and the suspension means being further removably attached to a tensioning means and the suspension means being further removably attached to user selected stable objects located in the area where the suspended sleeping surface is being set up.

7. The suspended sleeping surface as described in claim 6 further comprising:

one or more tent wand hoops removably attached to the removably attached sections of the hiking stick and the floor;

a tent enclosure removably attached to the tent wand hoops;

a fly weathershield removably attached to the tent wand hoops made of suitable moisture resistant material and removably attached such that the fly weathershield protects the tent enclosure from moisture, the floor and a space beneath the floor but above the ground and the fly weathershield is further removably attached such that the fly weathershield is suspended over the tent enclosure and the floor permitting air to pass there between.

8. The new and improved suspended sleeping surface and hiking stick use combination as described in claim 7 wherein the non-tensioning suspension means and the suspension means are removably attached to an attachment means wherein the attachment means, and not the non-tensioning suspension means nor the suspension means, are removably attached to user selected stable objects located in the area where the suspended sleeping surface is being set up.

9. The suspended sleeping surface as described in claim 6 wherein the non-tensioning suspension means and the suspension means are removably attached to an attachment means wherein the attachment means, and not the non-tensioning suspension means nor the suspension means, are removably attached to user selected stable objects located in the area where the suspended sleeping surface is being set up.

10. A suspended sleeping surface comprising:

a floor having a head end and a foot end;

a stiffening means removably attached to the head end of the floor;

at least two suspension means removably attached to the head end being further removably attached to a tensioning means and the suspension means being further removably attached to user selected stable objects located in the area where the suspended sleeping surface is being set up;

the stiffening means further being removably attached to the tensioning means that is removably attached to the head end of the suspended sleeping surface once set up; and at least one suspension means removably attached to the foot end being further removably attached to user selected stable objects located in the area where the suspended sleeping surface is being set up.

11. The suspended sleeping surface as described in claim 10 further comprising:

one or more tent wand hoops removably attached to the floor;

a tent enclosure removably attached to the tent wand hoops;

a fly weathershield removably attached to the tent wand hoops made of suitable moisture resistant material and removably attached such that the fly weathershield protects the tent enclosure from moisture, the floor and a space beneath the floor but above the ground and the fly weathershield is further removably attached such that the fly weathershield is suspended over the tent enclosure and the floor permitting air to pass there between.

12. The suspended sleeping surface as described in claim 11 wherein the suspension means is removably attached to an attachment means wherein the attachment means and not the suspension means is removably attached to user selected stable objects located in the area where the suspended sleeping surface is being set up.

13. A method of using the suspended sleeping surface as described in claim 12 comprising the steps of:

removably attaching at least two of the suspension means to the head end;

removably attaching at least one of the suspension means to the foot end;

removably attaching the suspension means to the tensioning means;

removably attaching the attachment means to user selected stable objects located in the area where the suspended sleeping surface is being set up;

removably attaching the suspension means to the attachment means;

applying tension which is transmitted through the suspension means to the floor by use of the tensioning means;

adjusting the attachment means at one or more of the points where the attachment means is removably attached to the stable objects located in the area while applying tension to bring the floor to a flat and level position as the tension is applied;

applying additional tension transmitted through the suspension means to the floor by use of the tensioner once the floor is leveled and flat;

removably attaching the stiffening means to the tensioning means such that the floor is taut and able to support one or more users to minimize sagging;

removably attaching the tent enclosure to the floor;

stabilizing the tent enclosure by removably attaching and tightening to the tent enclosure one or more stabilizing means which is further removably attached to the suspension means; and removably attaching the fly weathershield to the floor whereby the fly weathershield is suspended above the tent enclosure and the floor allowing air to pass there between and further protect the tent enclosure and the floor from moisture.

14. The suspended sleeping surface as described in claim 10 wherein the suspension means is removably attached to an attachment means wherein the attachment means and not the suspension means is removably attached to user selected stable objects located in the area where the suspended sleeping surface is being set up.

* * * * *